US012304674B2

(12) United States Patent
Luber et al.

(10) Patent No.: US 12,304,674 B2
(45) Date of Patent: May 20, 2025

(54) PACKAGING APPARATUS AND METHOD FOR PRODUCING PACKAGING UNITS

(71) Applicant: Krones Aktiengesellschaft, Neutraubling (DE)

(72) Inventors: Johann Luber, Bad Feilnbach (DE); Thomas Stadler, Kolbermoor (DE); Tobias Gut, Unterhaching (DE); Herbert Spindler, Niedermoosen (DE); Markus Gabler, Rohrdorf (DE)

(73) Assignee: Krones Aktiengesellschaft, Neutraubling (DE)

( * ) Notice: Subject to any disclaimer, the term of this patent is extended or adjusted under 35 U.S.C. 154(b) by 547 days.

(21) Appl. No.: 17/610,751

(22) PCT Filed: Apr. 24, 2020

(86) PCT No.: PCT/EP2020/061561
§ 371 (c)(1),
(2) Date: Nov. 12, 2021

(87) PCT Pub. No.: WO2020/233943
PCT Pub. Date: Nov. 26, 2020

(65) Prior Publication Data

US 2022/0234768 A1 Jul. 28, 2022

(30) Foreign Application Priority Data

| | | |
|---|---|---|
| May 17, 2019 | (DE) | 10 2019 113 176.6 |
| Oct. 25, 2019 | (DE) | 10 2019 128 874.6 |
| Dec. 19, 2019 | (DE) | 10 2019 135 254.1 |

(51) Int. Cl.
*B65B 17/02* (2006.01)
*B65B 35/30* (2006.01)
(Continued)

(52) U.S. Cl.
CPC ..... *B65B 17/025* (2013.01); *B65B 35/30* (2013.01); *B65B 41/02* (2013.01); *B65B 61/02* (2013.01); *B65D 71/42* (2013.01)

(58) Field of Classification Search
CPC ..... B65B 2220/16; B65B 61/02; B65B 41/02; B65B 35/30; B65B 17/025; B65D 71/42; B65D 71/50
See application file for complete search history.

(56) References Cited

U.S. PATENT DOCUMENTS 2,936,070 A * 5/1960 Ougljesa ..... B65D 71/504 294/87.2
3,023,554 A * 3/1962 Hlavacek ..... B65B 17/02 53/399
(Continued)

FOREIGN PATENT DOCUMENTS

DE 3046423 A1 7/1982
DE 102013113754 A1 6/2015
(Continued)

OTHER PUBLICATIONS

Extended European Search Report for Divisional Application dated Dec. 23, 2021.
(Continued)

*Primary Examiner* — Andrew M Tecco
(74) *Attorney, Agent, or Firm* — Simmons Perrine Moyer Bergman PLC

(57) ABSTRACT

The invention relates to a packaging apparatus (1) and a method used to produce packaging units (35). The packaging units (35) comprise at least one article (30), such as a beverage can (31), held in a packaging blank (20) having at least in some portions or areas that are flat. The packaging blank (20) has at least one passage opening (23) in the flat portion or area for article(s) (30). The packaging apparatus (1) comprises a feeder device (2); a pre-treatment module
(Continued)

(9) to prepare the packaging blank (20) for the application to the article(s) (30); and a first packaging module (7) to apply and locate the packaging blank (20) to the article(s) (30). The pre-treatment module (9) comprises a device to reduce a resistance force in an edge area (24) of the passage openings (23) during the application of the packaging blank (20) to the article(s) (30).

14 Claims, 26 Drawing Sheets

(51) Int. Cl.

| | |
|---|---|
| ***B65B 41/02*** | (2006.01) |
| ***B65B 61/02*** | (2006.01) |
| ***B65D 71/42*** | (2006.01) |

(56) References Cited

U.S. PATENT DOCUMENTS

| | | | | |
|---|---|---|---|---|
| 3,032,944 | A | 5/1962 | Elwin et al. | |
| 3,137,109 | A * | 6/1964 | Rapata | B65D 71/50 53/398 |
| 3,407,563 | A | 10/1968 | Dieter et al. | |
| 3,509,684 | A * | 5/1970 | Hohl et al. | B65B 17/025 53/142 |
| 3,742,677 | A | 7/1973 | Best | |
| 4,116,331 | A | 9/1978 | Curry et al. | |
| 4,805,372 | A | 2/1989 | Nigrelli | |
| 4,817,361 | A | 4/1989 | Cunningham | |
| 4,953,342 | A | 9/1990 | Hynes | |
| 5,088,269 | A * | 2/1992 | Thelen | B65D 71/504 53/48.2 |
| 5,117,609 | A | 6/1992 | Seymour et al. | |
| 5,125,506 | A * | 6/1992 | Galbierz | B65B 17/025 206/151 |
| 5,237,796 | A * | 8/1993 | Bonkowski | B29C 66/24221 53/442 |
| 5,359,830 | A | 11/1994 | Olson et al. | |
| 5,791,121 | A * | 8/1998 | Bernier | B65B 17/025 53/390 |
| 8,112,970 | B2 * | 2/2012 | Marco | B65B 17/025 53/556 |
| 8,448,411 | B2 | 5/2013 | Huber et al. | |
| 11,453,516 | B2 * | 9/2022 | Kooc | B65B 17/025 |
| 11,511,895 | B1 * | 11/2022 | L'Heureux | B65B 57/16 |
| 11,623,804 | B2 * | 4/2023 | Slovik | B65D 71/504 206/145 |
| 2011/0030311 | A1 | 2/2011 | Martini | |
| 2017/0190488 | A1 | 7/2017 | Bates | |
| 2019/0092503 | A1 | 3/2019 | Daniel et al. | |
| 2019/0119019 | A1 * | 4/2019 | Patton | G09F 23/00 |
| 2020/0361645 | A1 | 11/2020 | Spindler et al. | |
| 2021/0086971 | A1 * | 3/2021 | Berga Ferres | C12N 5/0075 |

FOREIGN PATENT DOCUMENTS

| | | | | |
|---|---|---|---|---|
| DE | 202018106535 | U1 | 1/2019 | |
| WO | WO-9511174 | A1 * | 4/1995 | B65D 71/42 |
| WO | 9906280 | A1 | 2/1999 | |
| WO | WO-2018049429 | A1 * | 3/2018 | B65B 17/025 |

OTHER PUBLICATIONS

PCT/EP2020/061559 International Preliminary Reports of Patentability dated Dec. 2, 2021.
PCT/EP2020/061561 International Preliminary Reports of Patentability dated Dec. 2, 2021.
DE 10 2019 135 254.1 German Search Report dated Aug. 24, 2020.
European International Search Report and Written Opinion dated Jul. 21, 2020.
European Patent Application—Extended European Search Report dated Sep. 21, 2020.
German Application No. DE 10 2019 128 874.6—German Search Report dated Aug. 12, 2020.
Patent Application No. 10 2019 113 176.6 filed May 17, 2019 in Germany—German Search Report dated Feb. 12, 2020.
PCT/EP2020/061559 International Search Report dated Aug. 28, 2020.
European Patent Application EP20719915.9—Office Action dated Apr. 3, 2024.
European Patent Application EP20719916.7—Office Action dated Apr. 8, 2024.

* cited by examiner

PACKAGING APPARATUS AND METHOD FOR PRODUCING PACKAGING UNITS

CLAIM OF PRIORITY

The present application claims priority to International Application PCT/EP2020/061561, filed Apr. 24, 2020, which in turn claims priority to German Application DE 10 2019 113 176.6, filed May 17, 2019, German Application DE 10 2019 128 874.6, filed Oct. 25, 2019, and German Application DE 10 2019 135 254.1 filed Dec. 19, 2019, which are incorporated by reference.

FIELD OF THE INVENTION

The present invention relates to a packaging apparatus and a method used to produce packaging units according to the features of the independent claims.

BACKGROUND OF THE INVENTION

There is a variety of different packaging alternatives that are used to process, assemble, group, and package articles such as beverage containers. A frequently used variant, for example, consists in gathering together a plurality of articles or containers of the same type into portable, relatively handy pack units or packaging units. There are also various possibilities known to gather together individual articles or containers into larger packs. Beverage containers, for example, are mostly gathered together by shrink films and packaged into packs of four, six, or more containers. It is usually inevitable to produce packs, because packs are the most common type of packaging units for beverage containers or bottles made of PET plastic material. Some packs are further gathered together and/or assembled in layers and placed on pallets for transport purposes.

The production of the known pack types requires specific production steps in order to be able to process the shrink films commonly used for the packs. These production steps require a relatively high energy input, not least due to the shrinking process of the film taking place under heat exposure. The use of the film also entails costs for production, supply, handling, and subsequent waste disposal, because the film is no longer needed after the articles or packs have been sold and unwrapped. The machinery for supplying the so-called film wrapping modules and other handling stations also causes high investment costs. A relatively high input of capital is finally required for supplying the so-called shrink tunnel, where the film that the packs are wrapped into is shrunk around the containers by the application of hot air.

So-called strapped packs represent a packaging variant that generally makes it possible to dispense with the use of shrink films. For this variant, the containers are assembled to a pack and held together by so-called strapping tapes. Continuously or cyclically operated strapping machines are used to group containers, articles, or bottles into formations, which are then strapped together with a strapping tape or with a plurality of strapping tapes by employing strapping aggregates. Typical formations include, for example, 1×2 arrangements (two containers in a row), 2×2 arrangements (four containers in a square or in a rhomboid formation), 3×2, 4×3, or generally any other variable N×M arrangement.

Another known variant involves the use of so-called top gripping type cartons to gather together a plurality of bottles via their neck areas, for example. The patent document EP 1 075 419 B1 describes a packaging machine used to set up such top gripping type cartons. In this context, the articles or containers are arranged in a crate, and the gripping type carton is lowered from above onto the at least one article arranged in the crate. In particular, there is a plurality of articles arranged in the crate, and subgroups are formed by positioning a smaller number of top gripping type cartons, with the subgroups each gathering together a part of the articles arranged in the crate.

The arrangement and number of passage openings of a gripping type carton corresponds to the arrangement and number of articles or containers to be gathered together. As a rule, the diameter of the passage openings is slightly smaller than a maximum diameter of an upper area of the articles. The gripping type carton is lowered and pressed onto the articles such that a defined upper area of the articles is pushed through the passage openings. In particular, an upper area with a maximum diameter is pushed through the passage openings, and the edge areas of the passage openings are brought into engagement with the articles below this maximum diameter such that the gripping type carton is safely and firmly located on the articles. Relatively high application forces are necessary to locate the gripping type carton on the articles in such a manner, in particular, to push the articles through the passage openings. The articles accordingly must be able to meet this application force with an appropriate resistance in order for the articles not to be damaged during the positioning of the gripping type carton.

The object of the invention lies in eliminating the disadvantages of the apparatuses known from the prior art.

SUMMARY OF THE INVENTION

The above object is solved by a packaging apparatus and a method used to produce packaging units, the packaging apparatus and the method comprising the features of the independent claims. Further advantageous embodiments of the invention are described in the subclaims.

The below-described method carried out by a packaging apparatus to produce packaging units is particularly directed to reducing the application force necessary to locate a gripping type carton to an article group. The packaging units produced in the process comprise at least one article or container that has at least one designed packaging blank arranged thereto, with the packaging blank having some portion or area that is flat and at least one passage opening in the flat portion or area for at least one article.

Normally, however, the packaging units produced in the process comprise two or more articles or containers gathered together and having at least one packaging blank arranged thereto, in each instance with the packaging blank having a passage opening in flat portion or area for each of the articles or containers, whereby the two or more articles or containers are mechanically held together.

The at least one article or container is preferably a beverage container, in particular a bottle made of PET or another suitable plastic material. Preferentially, the articles or containers can also be formed as cans made of plastic and/or aluminum or of another metal or the like. The packaging apparatus and the method are however also suitable to arrange and locate an appropriate packaging blank to other suitable articles or containers.

The flat packaging blank can in particular be made of recyclable cellulosic materials. For example, the flat packaging blank can be made of paperboard and/or cardboard, which can be recycled without problems after use. It is moreover conceivable that the flat packaging blank is made of plastic material, in particular using single-material thermoplastics, which are likewise good to recycle.

If required, it is possible for the flat packaging blank to have a number of cutouts that together form a carrying handle.

The flat packaging blank can be composed of a plurality of cellulosic layers, for example, or of a combination of different materials, and also of different recycled materials.

A packaging apparatus used to produce such packaging units comprises at least one feeder device for the at least one article or for assemblies of at least two articles, a pre-treatment module to prepare the packaging blank for the application to the at least one article, and a first packaging module to apply and locate the packaging blank to the at least one article. In this context it is provided that the pre-treatment module comprises at least one device designed to reduce a resistance force in an edge area of the at least one passage opening of the packaging blank during the subsequent application of the packaging blank to the at least one article.

The packaging units produced according to a particularly preferred embodiment consist of at least two articles or containers gathered together by at least one first secondary packaging device in the form of a flat packaging blank. All features described below in relation to such packaging units are also applicable in an analogous or appropriately adapted manner to packaging units comprising only one article and a thereto located packaging blank. A packaging blank formed with a carrying handle blank to provide a carrying handle is in particular referred to in this instance.

Furthermore, the articles or containers of the packaging units can be additionally gathered together by at least one other secondary packaging device. The additional second secondary packaging device is formed, for example, by at least one tape- or strip-like, full circle strapping tensely wrapped horizontally around an outer side of the articles or containers and optionally firmly secured at a contact point to at least one of the articles.

The strapping can in particular be secured at the contact point by a material-bonded connection in the form of at least one welded joint. Such a contact point of the strapping with one of the outer surfaces of the articles is however by no means mandatory, since the strapping can already adhere firmly to the outer surfaces of the strapped articles by the strapping tension applied thereto. Alternatively and additionally, the articles can be secured to each other by adhesive bonds.

The linear or point-shaped or flatly delimited adhesive bonds are expediently situated at contact surfaces or contact edges of the adjacently positioned articles such that all in all only relatively small glued surfaces can already provide for a firm connection between the articles. Another alternative embodiment can provide the articles gathered together with a packaging blank to be additionally arranged on a so-called tray and/or to be wrapped in shrink film. In the instance of at least one strapping with the articles arranged on a tray, the arrangement of the second secondary packaging device can be carried out prior to or simultaneously with or after the application of the packaging blank.

The application of an adhesive to form adhesive bonds is preferably carried out before or in a temporal connection with the assembling of the articles into an article group prior to the application of the packaging blank, whereas the application of a shrink film is preferably carried out after the application of the packaging blank, in particular, so that the shrink film is shrunk onto the articles gathered together with the packaging blank.

The packaging blank has at least two passage openings in the flat portion for the at least two articles. Furthermore, the flat portion of the packaging blank can have carrying handle openings for the user to pass the fingers through in order to be able to lift up and transport or the like the entire packaging unit using the carrying handle.

In particular, the packaging blank is a so-called top gripping type carton. The packaging blank is preferably made of a cardboard material, a plastic material, a cardboard-plastic composite material, or the like.

After locating the packaging blank, a defined upper area of the articles is preferably situated above the packaging blank, while a defined lower area of the articles is arranged below the packaging blank.

According to one embodiment, the passage openings of the packaging blank have suitable securing devices, which can be formed by securing tabs, for example. The securing tabs are formed, for example, by cuts or the like extending radially from the openings. After arrangement and fastening of the packaging blank to the articles, the packaging blank is in engagement with the articles in such a manner that it is substantially stationarily located to the articles and such that the articles can no longer make any significant relative movements or position changes relative to each other or relative to the packaging blank. The packaging blank can thus only be removed from the articles of the article group with an increased effort and with an upward directed force component, which normally leads to at least partially destroying the packaging blank.

The packaging apparatus comprises at least one feeder device via which the at least two articles are fed. Preferably, the articles are already previously assembled in a suitable number and arrangement to article groups, which are fed via the at least one feeder device to a packaging module. In the packaging module, a packaging blank is applied and located to the article group. To this end, a packaging blank is taken from a magazine and prepared in a pre-treatment module for the application to the at least two articles of the article group. For this purpose, the pre-treatment module comprises at least one device designed to reduce a resistance force in an edge area of the passage openings of the packaging blank during the subsequent application of the packaging blank to the at least two articles, a so-called resistance reducing device.

According to a first embodiment, the resistance reducing device of the pre-treatment module comprises at least one stretching die, preferably however a plurality of stretching dies, which is/are suitable to stretch and/or expand the edge areas of the at least one passage opening. In this instance, an average diameter of the at least one passage opening is at least slightly enlarged by the pre-treatment. An upper area of articles with a maximum diameter that is preferably at least slightly larger than an average diameter of the passage openings can thereby be more easily passed through the particular passage opening.

The application force used to press the packaging blank onto the articles such that the upper area of the articles with a maximum diameter is arranged above the packaging blank and the lower area of the articles is arranged below the packaging blank is in particular significantly reduced in relation to an application force that would be necessary to locate a packaging blank without pre-treatment to the articles. The risk of damaging the articles during the positioning of the packaging blank is thus also reduced in relation to customary packaging apparatuses and packaging methods. In this instance, it is even possible to use articles having less wall thickness without damaging the articles during the positioning of the packaging blank.

According to one embodiment, the at least one stretching die is arranged in the pre-treatment module in a detachable manner. The stretching dies are formed, for example, by differently designed molded parts. The molded parts can in this context substantially have the form of the articles to which the particular packaging blank is to be applied. The stretching dies are made of a rigid solid material, for example, or they at least have a greater stability than the particular articles. The in each instance suitable stretching dies are arranged in the pre-treatment module in the appropriate number and arrangement depending on the articles and the corresponding packaging blanks.

The packaging blank is positioned on the stretching dies and pressed down such that partial areas of the stretching dies in each instance pass through the passage openings and thereby in particular come into engagement with the edge areas of the passage openings. This causes stretching or another modification of the edge areas of the passage openings, and in particular, the material in the edge areas of the passage openings is weakened. Preferably, an average diameter of the passage openings is increased by the stretching dies.

According to one embodiment, the stretching dies have a conical or truncated cone form, with the apex or the end of the cone with the smaller cross-sectional area facing upward. In this instance, the stretching dies are suitable for different sizes of articles. Depending on the average diameter of the passage openings, the packaging blank is pressed downward correspondingly far to expand the passage openings in the desired manner.

The arrangement and number of the stretching dies corresponds in particular to the number and arrangement of the passage openings of the packaging blank. In the instance of a change of product, a pre-treatment module with detachably arranged stretching dies thus makes it possible to convert to the new product in a simple, quick, and cost-efficient manner.

It should be pointed out explicitly here that this aspect of a simple and quick conversion of the stretching dies can be particularly advantageously realized with different exchangeable module parts, which can be placed into packaging machines and removed as well as exchanged for other module parts with a different division and/or with the stretching dies differently spaced apart.

It is accordingly possible that the working tool comprises at least one centering device in the form of the mentioned stretching dies, with the centering device pre-treating the openings of a flat packaging blank provided to receive the articles, containers, or beverage cans temporally before positioning the particular packaging blank, in particular by widening and/or stretching the edges of the openings far enough for the articles, containers, or beverage cans to be gathered together in order to more easily slide thereinto or be more easily received thereinto.

A preferably provided step of the method provides a pre-treatment of the flat packaging blank in order to reduce a resistance force occurring in an edge area of the openings of the particular flat packaging during a later positioning of the flat packaging blank.

It is possible in this context for an average diameter of the openings to be in each instance enlarged during the pre-treatment.

It is also possible that securing tabs formed in the particular edge areas of the openings are at least in some areas folded over such that the securing tabs subsequently protrude from a plane in which the openings are arranged.

In this context, it is provided that the flat packaging blank is pressed onto a device with at least one die or with at least one stretching die during the pre-treatment. It is possible in this context that the number and arrangement of the dies or of the stretching dies corresponds to the number and arrangement of the openings of the flat packaging blank, with the flat packaging blank being pressed onto the dies or onto the stretching dies in such a manner that the dies or the stretching dies at least in some areas pass through the openings.

If a plurality of dies or a plurality of stretching dies are provided, the plurality of dies or the plurality of stretching dies can be gathered together in one format part.

One aspect can therefore relate to a format part for the pre-treatment of flat packaging blanks each having a plurality of openings, which format part

- has a carrier preferably formed as a carrier plate and also
- comprises a plurality of stretching dies, with it being provided that
- the plurality of stretching dies are each arranged at the carrier that is preferably formed as a carrier plate, and the plurality of stretching dies each at least in some sections taper in the direction away from the carrier that is preferably formed as a carrier plate.

It is possible that cuts and/or perforations are in each instance introduced into the edge areas of the openings during the pre-treatment. It is in particular possible that radial cuts and/or radial perforations are introduced during the pre-treatment.

Embodiments with the edge area of the openings having moisture applied to or being moistened have also proved successful. It can be alternatively or additionally provided that the edge area of the openings is heated or that a temperature control device applies thermal energy specifically to edge areas of the openings.

It should be emphasized at this point that at least the aspect explained here relating to the exchangeability of the stretching die modules for such modules with other dimensions, spacing distances, and/or numbers of stretching dies within a module is regarded as an independent inventive idea.

According to one embodiment of the invention, a packaging blank is taken from a magazine by a suitable gripping tool and is transferred into the pre-treatment module and there lowered onto the device with the stretching dies and is in particular pressed thereonto such that the stretching dies at least in some sections pass through the passage openings of the packaging blank. The packaging blanks are preferably stacked on top of each other in a lying position in the magazine.

An arrangement of the packaging blanks in a standing position can alternatively be provided. In this instance, the gripping tool is preferentially designed to transfer the packaging blank situated in a vertical and angled arrangement into a horizontal alignment before pressing it onto the stretching dies. The arrangement of the stretching dies can alternatively be designed such that it is possible to press a packaging blank aligned in a vertical or angled arrangement thereonto. The packaging blank pre-treated by the stretching tools is subsequently conveyed to the packaging module by the gripping tool and positioned on an assembly of articles inside the packaging module and applied and located to the articles by being pressed thereonto. In this instance, a gripping tool can perform both transport steps.

Alternatively, a first gripping tool can be provided to take a packaging blank from the magazine and a second gripping tool to take and transport the pre-treated packaging blank from the pre-treatment module.

According to one embodiment, an expanding of the passage openings is carried out due to the packaging blank being pressed onto stretching tools with a downwardly expanding diameter, whereby the material in the edge area of the passage openings is partially compressed and/or whereby material of the edge areas is partially pushed upward out of the plane of the passage openings.

It can be provided, for example, that radial cuts within the edge area extend from the passage openings. The areas between the radial cuts form the so-called securing devices or securing tabs. When the packaging blank is pressed onto the stretching tools, the securing tabs are pushed upward such that the average diameter of the passage openings is increased after the packaging blank is taken from the pre-treatment module.

According to a further embodiment, it can be provided that radial perforations within the edge areas extend from the passage openings. When the packaging blank is pressed onto the stretching tools, the packaging blank is torn open at the perforations, and securing tabs are formed in the edge areas delimiting the passage openings, the securing tabs being pushed upward analogous to the above described manner.

The stretching tools with a downwardly expanding diameter in particular have the effect that the edge areas are bent within the packaging module opposite to the application direction. The application force to position the packaging blank on the articles is thereby reduced. The packaging blank is moreover centered and/or precisely positioned on the stretching tools and can thus be taken from the pre-treatment module and fed to the packaging module in a precisely positioned manner.

According to a further embodiment, the resistance reducing device of the pre-treatment module comprises at least one cutting device and/or perforating device. By introducing cuts or perforations into the edge area of the passage openings, the material in the edge areas of the packaging blank becomes more flexible, thereby reducing a resistance force when the packaging blank is pressed onto the articles.

In particular, it can be provided to combine the pre-treatment using a cutting device and/or perforating device with the pre-treatment using suitable stretching dies, in which instance cuts and/or micro-perforations and/or perforations are introduced by the cutting device and/or perforating device into the packaging blanks, in particular with the cuts and/or micro-perforations and/or perforations extending radially from the passage openings.

According to a further embodiment, the resistance reducing device of the pre-treatment module comprises at least one moistening device, in particular, a device with which edge areas delimiting the passage openings can be moistened. In the process, the edge areas of packaging blanks consisting of a cardboard material are preferentially treated with a fluid, while the fluid is not applied onto the remaining areas of the packaging blank.

The moistening device is a vaporizing device, for example, whereby water vapor is applied onto the appropriate edge areas of the packaging blank. By the moistening, the cardboard material in these areas is slightly softened and thereby becomes easier to deform. This also facilitates the subsequent application of the in this manner pre-treated packaging blank to the articles of the article group. After the packaging blank has dried, its original rigid material properties in the appropriate areas are restored. One embodiment can provide an additional suitable drying device to support, for example, by the specific application of warm air, the drying of the packaging blank located to the articles.

According to a further embodiment, the resistance reducing device of the pre-treatment module comprises at least one heating device with which in particular edge areas delimiting the passage openings can be heated. In particular, the edge areas of the passage openings of packaging blanks consisting of a thermoplastic plastic material are heated, while the remaining areas of the packaging blank are not heated.

By the specific heating, the plastic material in the correspondingly treated areas becomes softer and thereby also becomes easier to deform. This also facilitates the subsequent application of the in this manner pre-treated packaging blank been to the articles of the article group. After the packaging blank has cooled, its original rigid material properties are restored. One embodiment can provide an additional suitable cooling device to support, for example, by the specific application of cold air, the cooling of the packaging blank located to the articles.

According to a further embodiment, it can be provided that the preparation of the packaging blanks can already be carried out before they are supplied in a magazine of the packaging apparatus, which magazine can be assigned, in particular, to the packaging module of the packaging apparatus. Appropriately prepared packaging blanks with the securing tabs already pre-creased or the like, can be procured from a supplier, for example. The packaging blanks prepared by the supplier are then supplied to the packaging module in a magazine of the packaging apparatus. The prepared packaging blanks are taken from the magazine and positioned on the articles of the article group in the manner described above. It can be alternatively provided that an appropriate pre-treatment module is assigned to the magazine and that the preparation of the packaging blanks to reduce the resistance force in an edge area of the passage openings of the packaging blanks takes place inside the packaging apparatus before the prepared packaging blanks are arranged in a magazine and supplied for the subsequent application to the articles.

It is possible to reduce the application force used to secure the packaging blanks to the article groups by the pre-treatment of the packaging blanks. The risk of damage to the articles, in particular to beverage cans, is thereby reduced. The packaging apparatus according to the invention and the method according to the invention thus also make it possible to gather together articles and a packaging blank in packaging units if the articles have less wall thickness and are therefore more sensitive to compressive forces. This allows to save material, thereby making it possible to produce articles more cost-efficiently. In addition, the articles that can be designed from primary packaging with thinner walls, for example bottles or cans, result in producing less packaging waste that would otherwise have to be disposed of.

It should be explicitly mentioned at this point that all aspects and embodiment variants explained in the context of the apparatus according to the invention can likewise pertain to or constitute partial aspects of the method according to the invention. If specific aspects and/or interrelations and/or effects relating to the apparatus according to the invention are referred to at some point in the present description or in the claims definitions, this therefore likewise pertains to the method according to the invention. The same applies conversely, so that all aspects and embodiment variants explained in the context of the method according to the invention can likewise pertain to or constitute partial aspects of the apparatus according to the invention. If specific aspects and/or interrelations and/or effects relating to the method according to the invention are referred to at some point in the present description or in the claims definitions, this therefore likewise pertains to the apparatus according to the invention.

BRIEF DESCRIPTION OF THE FIGURES

In the following passages, the attached figures further illustrate typical embodiments of the invention and their advantages. The size ratios of the individual elements in the figures do not necessarily reflect the real size ratios. It is to be understood that in some instances various aspects of the invention may be shown exaggerated or enlarged in relation to other elements in order to facilitate an understanding of the invention.

Figure 1:
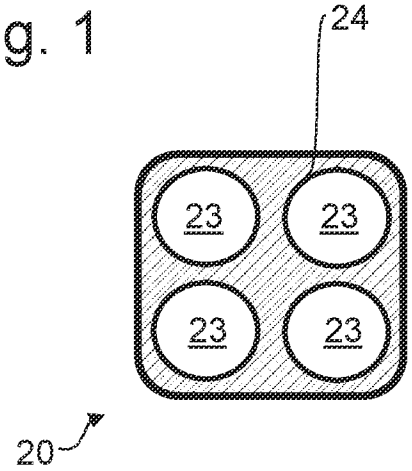
FIG. 1 shows a first embodiment of a packaging blank.

The same or equivalent elements of the invention are designated using identical reference characters. Furthermore and for the sake of clarity, only the reference characters relevant for describing the individual figures are provided. It should be understood that the detailed description and specific examples of the embodiments of the apparatus or of the method according to the invention are intended for purposes of illustration only and are not intended to limit the scope of the invention.

DETAILED DESCRIPTION OF THE INVENTION

The schematic view in FIG. 1 shows a first embodiment of a packaging blank 20. The schematic top view of FIG. 2 shows an article 30 from above, which article 30 can be gathered together with at least one further, in particular, identical article 30 into a packaging unit 35 or a pack 36 by a packaging blank 20.

Figure 2:
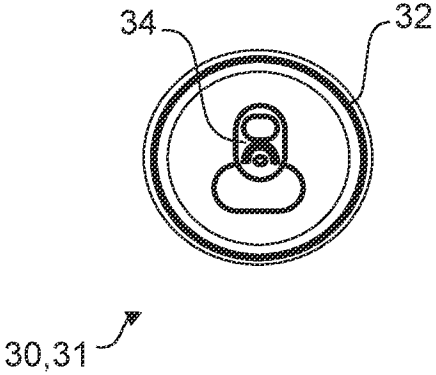
FIG. 2 shows an article.
Figure 3A:
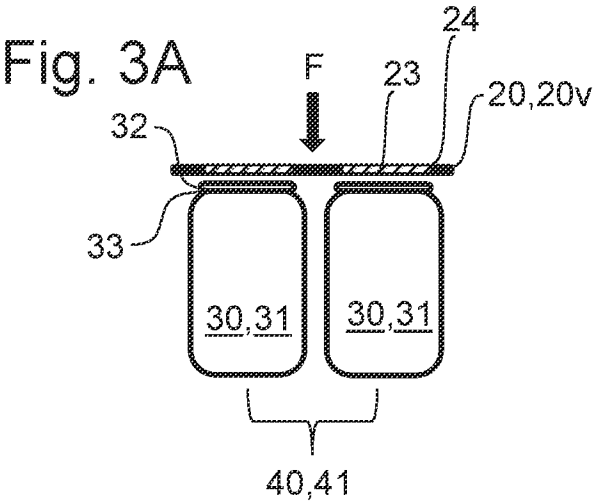
FIG. 3A and FIG. 3B schematically show the application of a packaging blank to an assembly of articles according to FIG. 2.
Figure 3B:
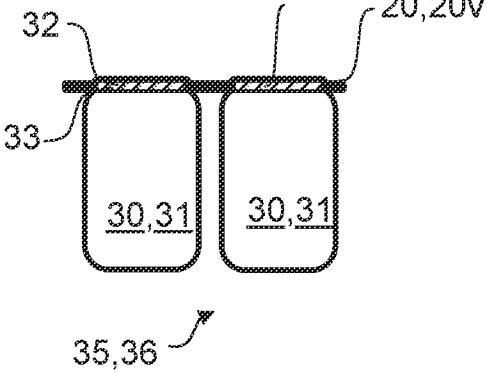

The side views of FIG. 3A and FIG. 3B schematically show the application of a packaging blank 20 to an assembly of articles 30 according to FIG. 2.

The articles 30 are preferentially beverage containers in the form of bottles or cans 31 made of plastic material and/or aluminum or of another suitable metal or the like. The packaging apparatus and the method are however also suitable to arrange and locate an appropriate packaging blank 20 to other suitable articles 30. Besides the cans 31 shown here, these could also be, for example, bottles made of mineral glass, PET beverage containers, or the like.

In some areas of the upper area, the articles 30 preferably have a widening to which the packaging blank 20 is located. In particular, the cans 31 have a lid edge 32. Below this lid edge 32, the cans 31 have at least a slight narrowing 33 or necking 33. As is discernible in outlines from the schematic side view in FIG. 3A, the necking 33 situated below the lid edge 32 has a smaller diameter than the outer surface of the particular can 31 situated below the necking 33 and also a smaller diameter than the lid edge 32 situated above the necking 33.

The cans 31 are, in particular, beverage cans as customarily known from the prior art, which can likewise be referred to with the reference number 31 in the present context.

It is preferentially provided that the packaging blank 20 is located to the cans 31 in the area of the narrowing 33 or necking 33 below the lid edge 32 after the packaging blank 20 has been positioned on the assembly of at least two cans 31. A partial area of the cans 31, more specifically the can lid with the closure 34, is thus situated above the packaging blank 20 after the positioning of the packaging blank 20 on the cans 31, while the remaining area of the cans 31 together with the outer surfaces thereof extends below the packaging blank 20. It is in particular provided that the packaging blank 20 is secured in this position by the cans 31 and vice versa.

If the articles 30 are, for example, bottles made of PET or of another suitable plastic material with a screw cap, the bottle has a widening in some areas in the form of a so-called neck ring below the screw cap. The diameter of the bottle below the neck ring is again designed to be smaller in some areas, and it widens downward from there. It is in particular provided that the packaging blank 20 is located below the so-called neck ring of the cap area to the bottles after the packaging blank 20 has been positioned on an assembly of bottles. The cap area and the neck ring of the bottles are thus situated above the packaging blank after the positioning of the packaging blank, while the remaining area of the bottles extends below the packaging blank.

The packaging blank 20 is designed to be substantially flat, for example, and it has passage openings 23 for the articles 30. The packaging blank 20 is designed in such a manner that it can be placed over the articles 30 from above, with the articles 30 at least partially passing through the passage openings 23 such that the articles 30 are situated with some areas above and with some areas below the packaging blank 20 after the fastening of the packaging blank 20 to an article group 41.

After locating the packaging blank 20, a defined upper area of the articles 30 is preferably situated above the packaging blank 20, while a defined lower area of the articles 30 is arranged below the packaging blank 20. In particular, an edge area 24 delimiting the passage openings 23 in this context abuts on the outer cover surface of the articles 30.

According to a preferred embodiment, the passage openings 23 of the packaging blank 20 can have suitable securing devices, which can be formed by securing tabs, for example. Securing tabs are formed, for example, by cuts or the like (not illustrated in FIG. 1, but cf. FIG. 9A, FIG. 9B in this context), which extend radially from the passage openings 23.

After arrangement and fastening of the packaging blank 2 to the articles 30, the packaging blank 20 is in engagement with the articles 30 in such a manner that the packaging blank 20 is substantially stationarily located to the articles 30 and such that the articles 30 can no longer make any significant relative movements or position changes relative to each other or relative to the packaging blank 20.

The packaging blank 20 can thus only be removed from the articles 30 of the article group 41 with an increased effort and with an upward directed force component, which normally leads to at least partially destroying the packaging blank 20. Such packaging blanks 20 are also referred to as top gripping type cartons. The packaging blank 20 is preferably made of a cardboard material, a plastic material, a cardboard-plastic composite material, or the like.

In order to produce a packaging unit 35, a packaging blank 20 is pre-treated to reduce a resistance force of the packaging blank 20 in the edge areas 24 delimiting the passage openings 23 during the application of the packaging blank 20 to the at least two articles 30. The pre-treated packaging blank 20 is in the following also referred to with the reference number 20*v*.

The pre-treated packaging blank 20*v* is placed onto a corresponding assembly 40 or article group 41 of at least two articles 30 and at least partially pressed onto and in the process secured to the articles 30 of the assembly 40 by an application force F, in particular, a downward directed pressure, that is at least partially directed downward or directed parallel to the longitudinal axes of the upright standing articles 30.

Due to the pre-treatment and the thereby reduced resistance force mentioned above and explained in more detail below, the application force F can be reduced in relation to the known prior art. It is thereby possible to also arrange packaging blanks 20*v* to such articles 30 that have less wall thickness, for example, and that are thus less resistant to compressive forces. In this manner, it is possible to reduce the material usage for the articles 30, because such a packaging blank 20 or 20*v* can also be used to gather together thinner walled and mechanically less stable articles 30.

By the advantageous reduction of the resistance force and thus of the application force F as well, it is additionally possible to position a plurality of packaging blanks 20*v* simultaneously or approximately simultaneously on upright standing articles 30 or beverage cans 31 and to thereby increase machine performance.

Figure 4:
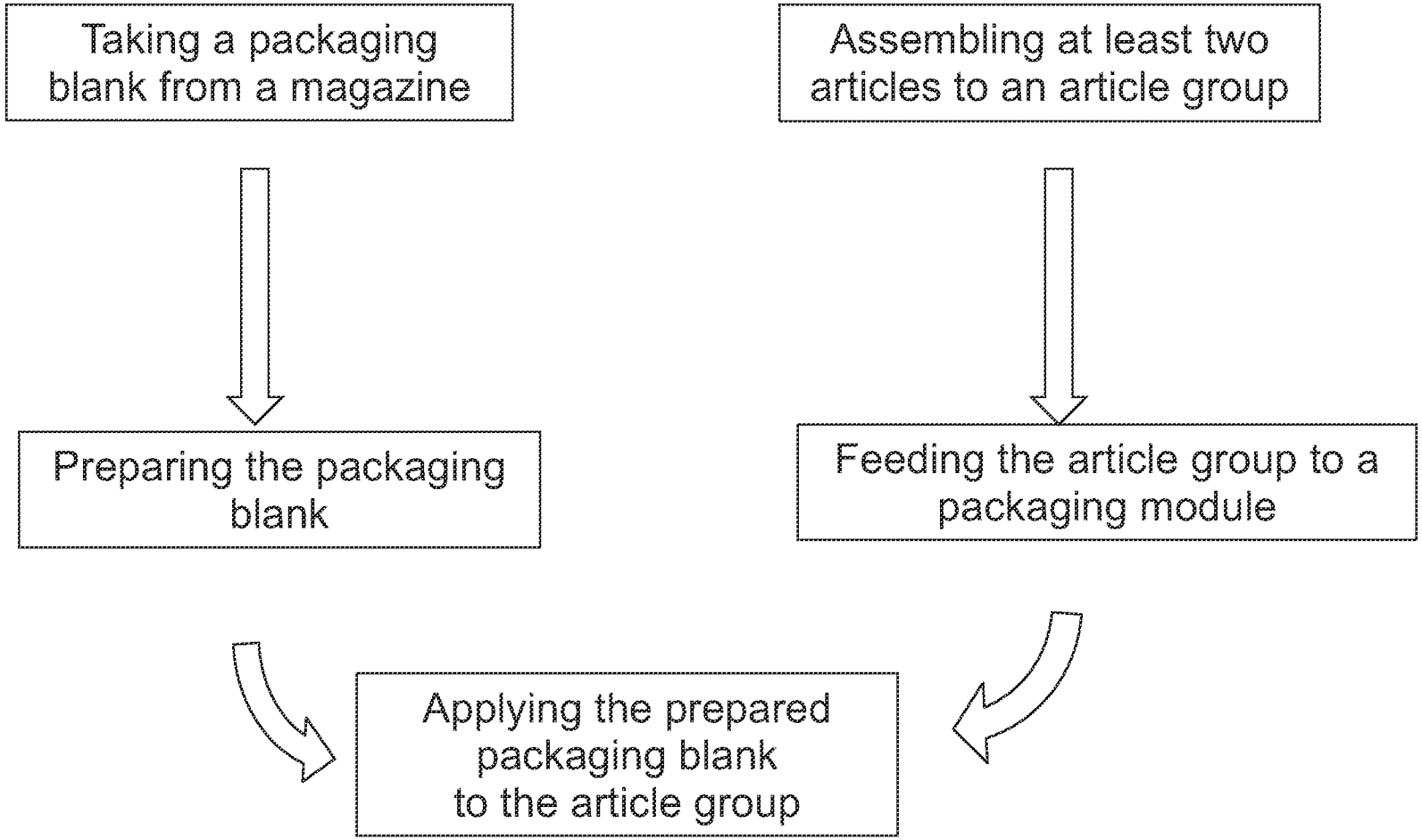
FIG. 4 shows a schematic procedure of a method used to produce packaging units according to the invention.

FIG. 4 shows a schematic procedure of a method used to produce packaging units 35 or packs 36. While at least two articles 30 are being assembled to an article group 41 (cf. FIG. 3A) in, for example, a divider module or the like, a packaging blank 20 is taken from a magazine assigned to the packaging module preferably substantially at the same time or at least close to the same time.

The article group is fed to the packaging module, and the packaging blank is prepared for the application to the article group by a suitable device of the packaging module or by a separate device assigned to the packaging module. A pre-treatment module for the packaging blanks, for example, is assigned to the packaging module, or such a pre-treatment module is integrated into the packaging module.

In the packaging module, the appropriately prepared packaging blank is positioned from above on the assembly of the at least two articles. The prepared packaging blank is in the process preferably brought into a form-locking and/or force-locking connection to the articles such that the articles are held inside the formed packaging unit at defined positions and, in particular, in a defined relative arrangement, by the packaging blank.

It can be furthermore provided that the articles are held together inside the packaging unit by at least one further secondary packaging device, for example by an additional strapping or the like encompassing all articles. This further secondary packaging device can be arranged and located to the articles before the application of the packaging blank, during the application of the packaging blank, or after the application of the packaging blank. This is in particular possible with the use of at least one strapping as a further secondary packaging device or with the additional arrangement of the articles on a tray or in a basket. If the further secondary packaging device is applied in the form of a shrink wrap, however, the application of the shrink wrap is carried out after the application of the packaging blank; in particular, a shrink film is wrapped around the articles and then shrunk onto the articles with the packaging blank holding the articles together.

Figure 5:
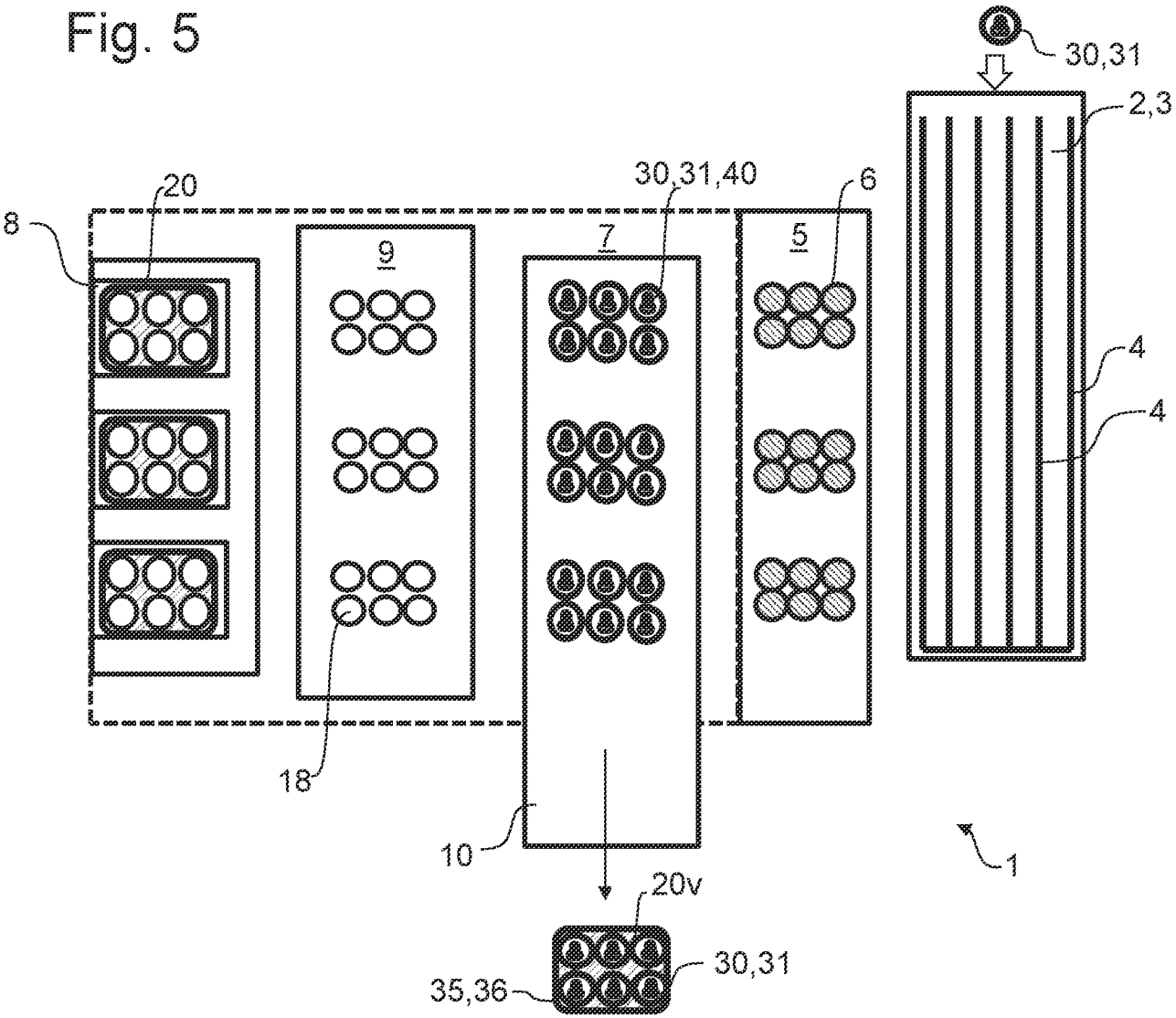
FIG. 5 shows a schematic illustration from above of a first embodiment of a packaging apparatus used to produce packaging units.

FIG. 5 shows a schematic illustration from above of a first embodiment of a packaging apparatus 1 used to produce packaging units 35 (also cf. FIG. 3B). The articles 30, formed for example by beverage-filled cans 31 or beverage cans 31, are fed via a feeding transport device 2.

In the present exemplary embodiment, the articles 30 are fed in individual rows in lanes 3 separated from each other by lane guides 4. The articles 30 are taken from the lanes 3 and each arranged on turntables 6 in a rotary module 5. The articles 30 can be aligned by the turntables 6 on the basis of specific equipment characteristics.

For example, it can be desirable for the trade that at least one barcode and/or other information carriers marking the articles 30 inside a packaging unit 35 faces/face outwardly and therefore is/are clearly visible. The alignment of the articles 30 can be in particular sensor-monitored and appropriately controlled. However, the alignment of the articles 30 is not important for the present invention; this alignment therefore only represents an optional component of the packaging apparatus 1.

The articles 30 are subsequently fed in the defined assembly 40 to a first packaging module 7 in order to apply and locate the secondary packaging device supplied in the form of packaging blank 20, with some flat portion(s), to the at least two articles 30.

The packaging module 7 can have at least one magazine 8 assigned to it in which flat packaging blanks 20 are provided. A first extraction tool (not illustrated here) takes at least one packaging blank 20 from the magazine 8 and transfers the packaging blank 20 to a pre-treatment module 9. The extraction tool can be a vacuum cup, for example, which suctions the packaging blank 20, in particular in the flat portions(s), in the magazine 8, transports it to the pre-treatment module 9, and deposits it there by the vacuum being dissipated. Alternatively, the packaging blank 20 can be held by a clamping or a suitable pneumatic force etc., which can be correspondingly disengaged.

The packaging blanks 20 undergo a pre-treatment in the pre-treatment module 9, with the effect that a resistance force of the packaging blanks 20 is reduced during the subsequent application to the assembly of at least two articles 30. In particular, a resistance force of the packaging blank 20 in an edge area 24 of the passage openings 23 of the packaging blank 20 is reduced in the process (cf. FIG. 1).

It is in particular provided in the process that an average diameter of the passage openings 23 is in each instance at least slightly enlarged or the like. The pre-treatment module 9 comprises suitable stretching tools 18, for example, such as are described in more detail in connection with FIG. 7 and FIG. 8.

The in this manner pre-treated packaging blank **20*v* is now taken from the pre-treatment module 9 by a second extraction tool, for example (not illustrated here), and the packaging blank 20*v* is pressed onto the assembly 40 of articles 30 (cf. FIG. 3A) from above and thereby located thereto. The second extraction tool thus simultaneously assumes the function of an application device. The articles 30 are arranged within the assembly 40 corresponding to the arrangement of the passage openings 23 of the packaging blank 20, 20*v***.

In the illustrated embodiment, it is provided that three packaging units 35 are in each instance produced in parallel with each other. In this respect, the packaging module 7 comprises three magazines 8 for packaging blanks 20, and the pre-treatment module 9, which can be integrated into the packaging module 7 or designed separately, has three devices for the pre-treatment of packaging blanks 20.

The articles 30 gathered together with the pre-treated packaging blank **20*v* into a packaging unit 35 or a pack 36 can now be fed via a removal conveyor belt 10 to a further packaging module (not illustrated here), for example, where at least one second (optional) secondary packaging device is additionally applied and located to the articles 30 of the packaging units 35 or of the packs 36**.

Such a second packaging module, which is to be considered as optional, can be a strapping module, for example, in which at least one strapping is applied to the articles 30 of the packs 36. In particular, at least one tape- or strip-like, full circle strapping is tensely wrapped horizontally around an outer side of the articles 30. If required, an inner side of the strapping abutting on the outer sides of the articles 30 can be firmly secured at a contact point to at least one of the articles 30. In this way, the strapping can in particular be secured at the contact point by a material-bonded connection in the form of at least one welded joint.

Alternatively, the further packaging module can also be a gluing module, for example, in which the articles 30 are secured to each other by adhesive bonds, for example by suitably placed adhesive points at contact points between two articles 30.

A further alternative embodiment can provide that the articles 30 gathered together with a pre-treated packaging blank **20*v* are arranged on a so-called tray or are wrapped in a shrink film, in which instance the shrink film is shrunk onto the articles 30 with the packaging blank 20*v* holding the articles 30** together.

Alternatively, the articles 30 gathered together with a pre-treated packaging blank **20*v* can be fed to a palletizing module, for example, where a plurality of packaging units 35** are assembled in a palletizable layer, and a plurality of these palletizable layers are stacked on top of each other.

According to an alternative embodiment not illustrated here, it can be provided that an appropriately pre-treated packaging blank is applied as a second secondary packaging device to an article group 41, in which the articles 30 are already being held together by a first secondary packaging device, in particular by a strapping and/or by adhesive bonds or the like.

Figure 6:
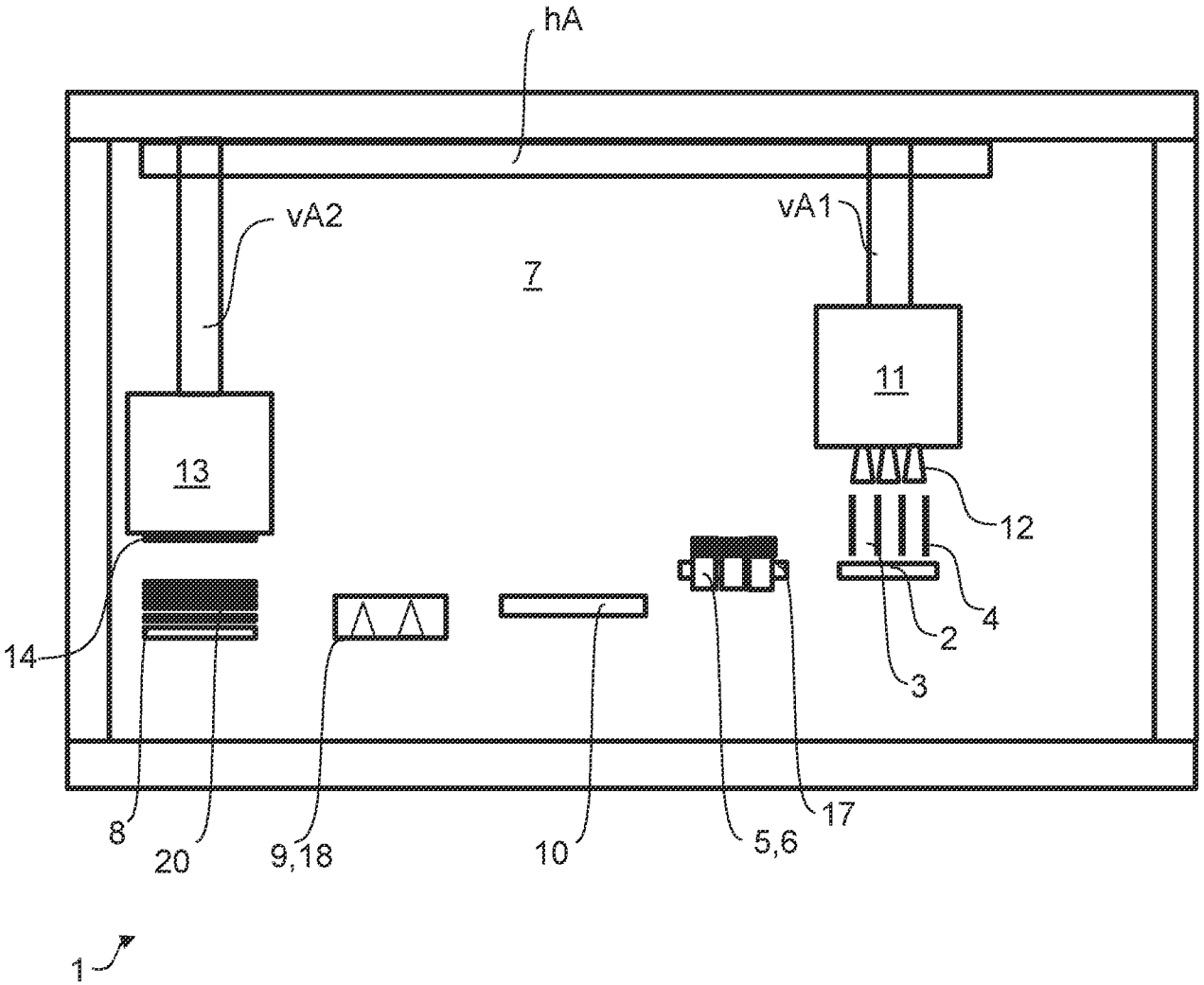
FIG. 6 shows a lateral view of a packaging apparatus according to FIG. 5.

FIG. 6 shows a schematic lateral view of a packaging apparatus 1 according to FIG. 5. The description of the reference numbers already referred to in connection with FIG. 5 is largely dispensed with here; the additionally visible features, however, will be in particular described.

The articles being fed via the lanes 3 are removed from the lanes 3 by a suitable first gripper head 11. The first gripper head 11 is equipped with an appropriate number and arrangement of packing bells 12, for example, in which instance it is possible to change the arrangement of the packing bells 12 relative to each other. For the removal of the articles from the lanes 3, the packing bells 12 can be situated, for example, in a first arrangement.

While the first gripper head 11 is conveying the articles toward the rotary module 5, the relative arrangement of the packing bells 12 is adjusted to the arrangement of the turntables 6 such that each article is deposited in each instance centered on a turntable 6. Each turntable 6 preferably has an own drive 17 assigned to it, for example a servomotor. In particular, the assembly of the articles as an article group is in this context carried out in accordance with the arrangement of the articles on the turntables 6.

The first gripper head 11 is vertically movable via a first vertical axis vA1, that is to say, the height of the first gripper head 11 can be appropriately adjusted, in particular, for the removal of the articles from the lanes 3 and for the placing of the articles on the turntables 6. The first gripper head 11 can furthermore be moved laterally between the feeding transport device 2 and the rotary module 5 via a horizontal axis hA.

The packaging blanks 20 provisioned in the magazine 8 are in each instance taken from the magazine 8 and fed to the above described pre-treatment module 9 via a suitable second gripper head 13, which is equipped with at least one vacuum cup 14, for example.

The second gripper head 13 is vertically movable via a second vertical axis vA2, that is to say, the height of the second gripper head 13 can be appropriately adjusted, in particular, for taking the provisioned packaging blanks 20 from the magazine 8 and for the deposit of the packaging blanks 20 in the pre-treatment module 9. The second gripper head 13 can furthermore be moved laterally between the magazine 8 and the pre-treatment module 9 via the horizontal axis hA.

Figure 7:
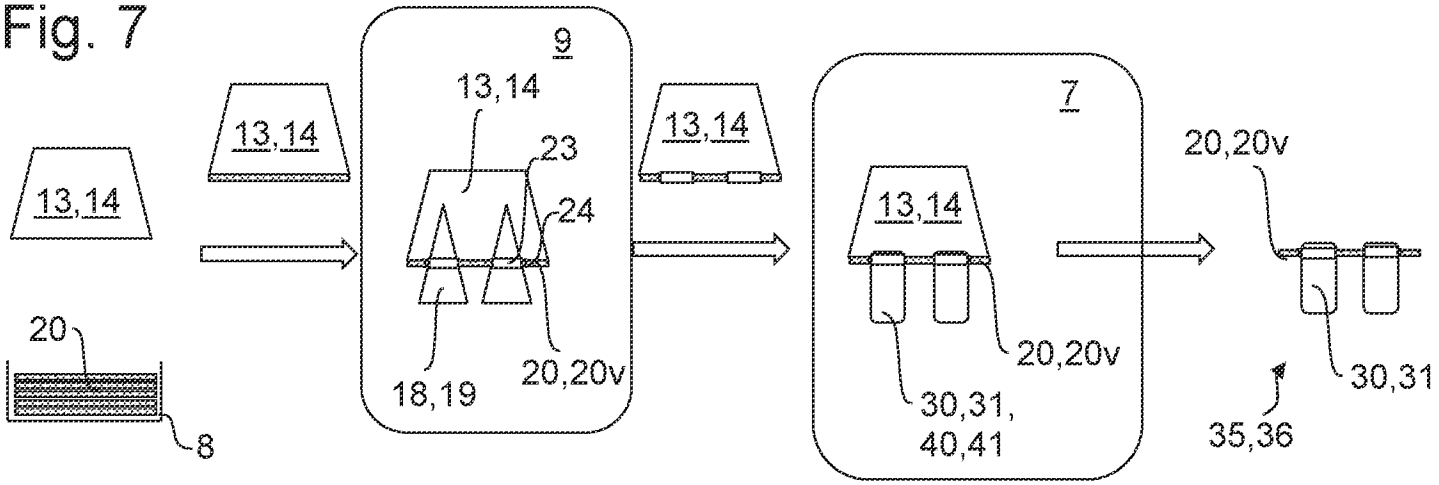
FIG. 7 shows a first embodiment of a pre-treatment module.

The illustrations of FIG. 7 show a first embodiment of a pre-treatment module 9. A packaging blank 20 is taken from a magazine 8 by a gripper head 13, for example, a vacuum cup 14, and transferred to the pre-treatment module 9. This pre-treatment module 9 comprises so-called stretching tools or stretching dies 18, which are designed in the form of the here so designated stretching cones 19, for example.

These stretching cones 19 are situated in a relative arrangement corresponding to the arrangement of the articles 30 in the finished packaging unit 35. In addition, the arrangement of the stretching cones 19 corresponds to the arrangement of the passage openings 23 of the packaging blanks 20. The packaging blank 20 is placed over the stretching cones 19 by the gripper head 13 such that in each instance one stretching cone 19 projects through in each instance one passage opening of the packaging blank 20.

The packaging blank 20 is pressed downward along the stretching cones 19 until the edge areas 24 of the passage openings 23 are stretched by the downwardly expanding cross section of the stretching cones 19, whereby the diameter of the passage openings 23 is at least slightly increased. The in this manner pre-treated packaging blank 20*v* is subsequently conveyed to the packaging module 7 by the gripper head 13 and applied to an article group 41.

The packaging blank 20 is centered and precisely positioned or aligned due to the slope of the stretching cones 19. It is preferably provided that the packaging blank 20 is at least briefly released from the gripper head 13 for the purpose of the centering. The pre-treated packaging blank 20*v* can subsequently be taken up in a precise manner by the gripper head 13 and can be applied on a corresponding assembly 40 of articles 30 and secured thereto by being pressed down.

Figure 8:
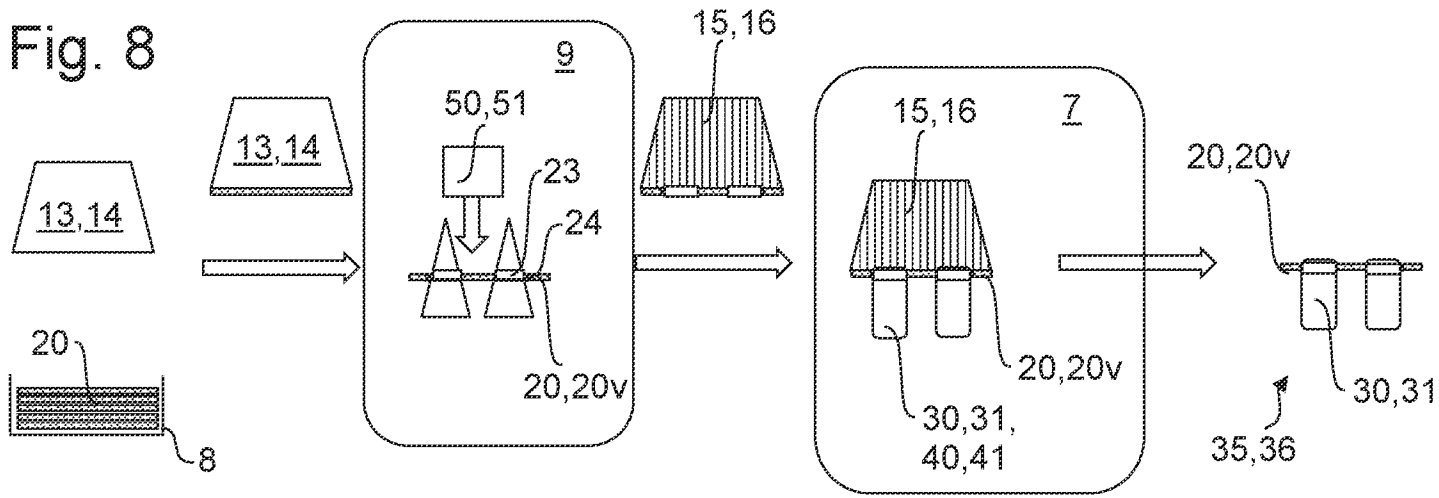
FIG. 8 shows a second embodiment of a pre-treatment module.

The illustrations of FIG. 8 show a second embodiment of a pre-treatment module 9. In this context, the packaging blank 20 is completely released inside the pre-treatment module 9 by the gripper head 13 and pressed onto the stretching cones 19 with the aid of a suitable tool 50, for example, a pressure punch 51, in order to expand the edge areas 24 of the passage openings 23 and in this manner reduce the resistance force of the packaging blank 20 in the edge areas 24.

The appropriately pre-treated packaging blank 20*v* is subsequently taken up by a third gripper head 15, which is likewise designed as a vacuum cup 16, for example, and conveyed from the pre-treatment module 9 to the packaging module 7.

As will be explained in more detail below, a plurality of stretching cones 19 arranged regularly or in a die can be placed into the packaging machine as modules gathered together and can be taken from there as required, which can be expedient in the instance of a change of product, for example, and a processing of packaging blanks 20 with changed dimensions, spaces of the passage openings 23, diameters of the passage openings 23, number of the passage openings 23 per packaging blank 20, etc.

The option of a modular exchange of a plurality of stretching cones 19 or of a die with a plurality of regularly arranged stretching cones 19, is in this context optionally also to be regarded as an independent aspect of the present invention.

Figure 9A:
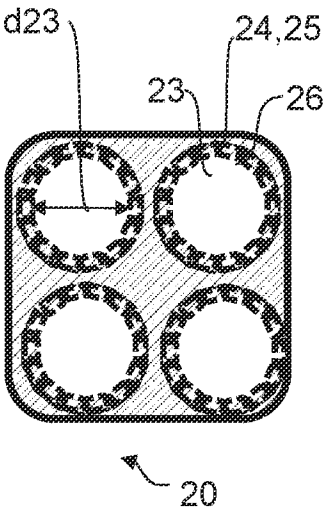
FIG. 9A to FIG. 9C show a first embodiment of a packaging blank and the corresponding pre-treatment and application of such a packaging blank to an article group.
Figure 9B:
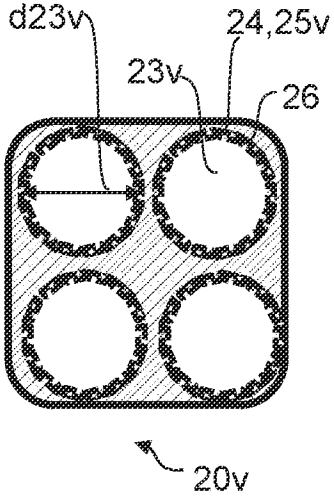
Figure 9C:
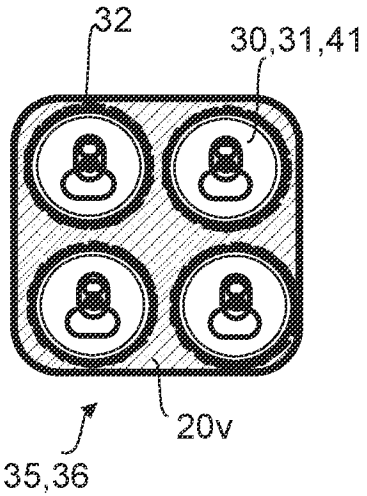

The schematic views of FIG. 9A to FIG. 9C show a first embodiment of a packaging blank 20 and the corresponding pre-treatment and application of such a packaging blank 20 to an article group 41 consisting of four articles 30, in particular, consisting of four cans 31.

FIG. 9A thus shows a packaging blank 20 before an appropriate pre-treatment, while FIG. 9B shows a packaging blank 20*v* after the appropriate pre-treatment. FIG. 9C shows a packaging unit 35 made of four articles 30 gathered together by a pre-treated packaging blank 20*v*.

Figure 10A:
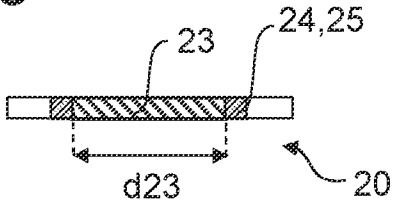
FIG. 10A and FIG. 10B show a partial area of the packaging blank according to FIG. 9A and FIG. 9B in a cross-sectional illustration.
Figure 10B:
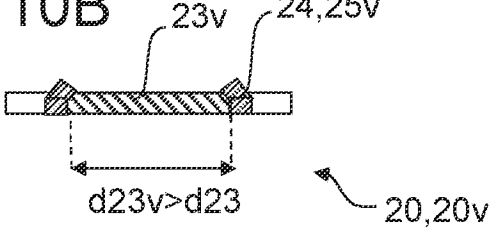

FIG. 10A and FIG. 10B show a partial area of the packaging blank 20, in particular, a partial area in a cross-sectional illustration comprising a passage opening 23 according to FIG. 9A and FIG. 9B.

The packaging blank 20 has four passage openings 23 with a mean or average diameter d23. So-called securing tabs 25 are in each instance formed in the edge areas 24 delimiting the passage openings 23. The securing tabs 25 are formed, in particular, by radial cuts 26 being provided which extend from the passage openings 23.

When the packaging blank 20 is pressed onto the stretching cones 19 as described in connection with FIG. 7 and FIG. 8 or by other suitable deforming devices, the securing tabs 25 are at least partially pushed upward and/or bent. The securing tabs 25 now protrude upward from the plane in which the passage openings 23 are situated (cf. FIG. 10B).

The average diameter of a passage opening 23 is increased by the upward push and/or by the upward bending of the securing tabs 25, which is indicated by the use of the reference number d23*v*. In particular, it applies that the average diameter d23 of a passage opening 23 of a packaging blank 20 prior to pre-treatment is smaller than the average diameter d23*v* of a passage opening 23*v* of a packaging blank 20 after the pre-treatment.

However, the enlarged average diameter d23*v* of a passage opening 23*v* after the pre-treatment is preferably always still at least slightly smaller than a maximum average diameter of the articles 30 in an upper area, in particular, in an upper area formed above the packaging blank 20*v* that is located to the articles 30 in the completed packaging unit 35.

The securing tabs 25 in the finished packaging unit 35 are preferably brought into engagement with the underside of the particular lid edge 32 of the cans 31 in such a manner that the packaging blank 20 is firmly secured to the cans 31 and cannot slip off upward (also cf. FIG. 3B).

Alternatively, the packaging blank 20 can have perforations extending radially away from the passage openings 23. When the packaging blank 20 is pressed onto the stretching cones 19, the perforations break apart, whereby corresponding securing tabs 25 are formed, which are bent upward when the packaging blank 20 is pressed further onto the stretching cones 19.

It is furthermore possible to expand a packaging blank 20 in the area of the passage openings 23 and correspondingly provide an at least slightly increased average diameter d23*v* by pressing the packaging blank 20 onto the stretching cones 19 if the packaging blank 20 has no securing tabs 25 or if the packaging blank 20 has no appropriate perforations to form securing tabs. In this context, in particular, the material of which the packaging blank 20 consists is pressed together and/or compressed in the edge areas 24 delimiting the passage openings 23.

Figure 11B:
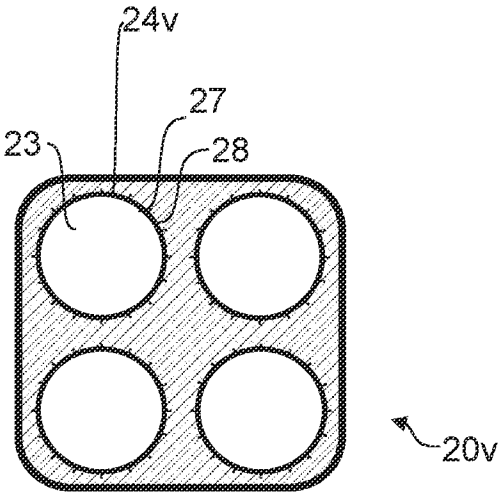
FIG. 11A to FIG. 11C show a second embodiment of a packaging blank and the corresponding pre-treatment and application of such a packaging blank to an article group.
Figure 11A:
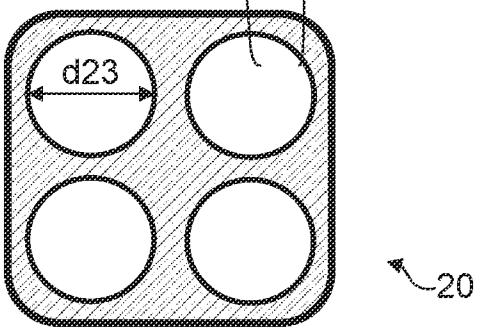
Figure 11C:
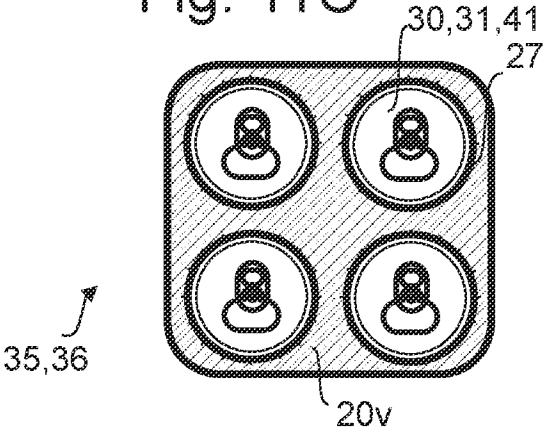

FIG. 11A to FIG. 11C show a second embodiment of a packaging blank 20 and the corresponding pre-treatment and application of such a packaging blank 20 to an article group 41.

In particular, FIG. 11A shows an untreated packaging blank 20 and FIG. 11B shows a pre-treated packaging blank 20*v*. In this context, it is provided that cuts 27 and/or micro-perforations are in each instance introduced into the edge area 24 of the passage openings 23 during the pre-treatment in order to reduce the resistance force in this area.

In particular, the cuts 27 introduced in such a manner extend radially from the passage openings 23. When the pre-treated packaging blank 20 is pressed directly onto the articles 30, the partial areas 28 formed between the cuts 27 can be pushed upward with little effort. In particular, it is also provided in this embodiment that the partial areas 28 engage below an in some areas maximum article diameter, whereby the packaging blank 20*v* is firmly located to the articles 30.

Furthermore, it can be provided that the pre-treatment is carried out in two stages, with cuts 27 and/or micro-perforations being introduced into the packaging blank 20 in a first pre-treatment step and the in this manner pre-treated packaging blank being pressed onto appropriate stretching dies, such as have already been described in detail in connection with FIG. 7 and FIG. 8, in a second pre-treatment step.

The schematic views of FIG. 12A to FIG. 12D show a third embodiment of a packaging blank 20 and the corresponding pre-treatment and application of such a packaging blank 20 to an article group 41.

Figure 12A:
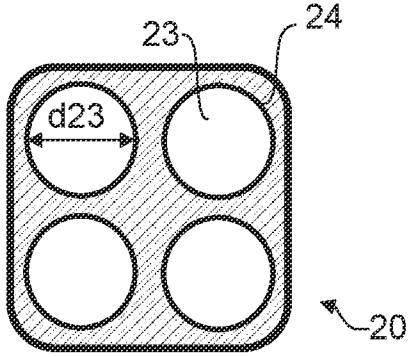
FIG. 12A to FIG. 12D show a third embodiment of a packaging blank and the corresponding pre-treatment and application of such a packaging blank to an article group.
Figure 12B:
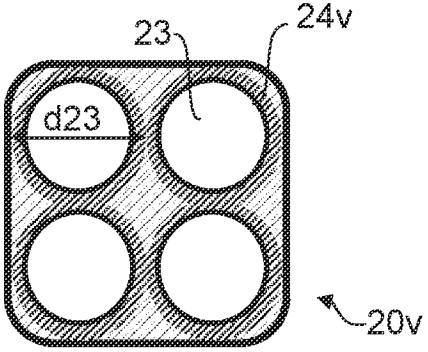

In particular, FIG. 12A shows an untreated packaging blank 20 and FIG. 12B shows a pre-treated packaging blank 20*v*. In this context, it is provided that the packaging blank 20 is in each instance made more unstable in the edge area 24 of the passage openings 23 by moistening. This is suitable, in particular, for packaging blanks 20 made of a cardboard material.

By the moistening, in which water vapor, for example, or another suitable fluid is applied onto the appropriate areas of the packaging blank 20 by a vaporizing device, the material of which the packaging blank 20 consists can be softened at least in some areas. In particular, the edge areas 24 delimiting the passage openings 23 for the articles 30 are hereby specifically moistened.

Figure 12C:
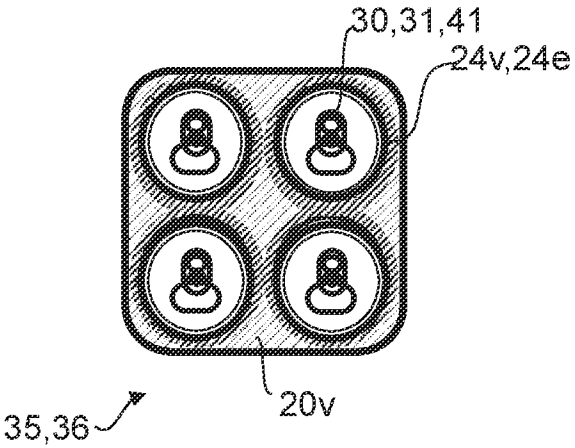

The packaging blank 20*v* with the in this manner softened edge areas 24*v* can now be applied to the articles 30 with less effort (FIG. 12C).

Figure 12D:
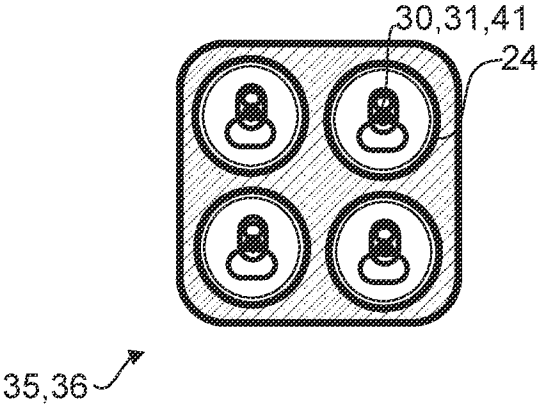

Furthermore, a subsequent drying step can be provided, in which the moistened edge areas 24*v* of the pre-treated packaging blank 20*v* applied to the articles 30 are dried by a suitable drying apparatus, for example, by drying air or the like. During drying, the stability appropriate to the material properties of the packaging blank 20 is restored to the edge areas 24 such that the packaging blank 20 abuts particularly firmly on the articles 30 (FIG. 12D).

If the packaging blank 20 consists of a thermoelastic plastic material, for example, it is possible by heating in some areas, in particular, by heating the edge areas 24 delimiting the passage openings 23, to increase the elastic properties in these heated areas. After the packaging blank 20*v* with correspondingly pre-treated, in particular heated edge areas 24*e* of the passage openings 23 has been applied to an article group 41, the edge areas 24 of the passage openings 23 connect to the outer cover surfaces of the articles 30 in a particularly advantageous manner during cooling.

Figure 13:
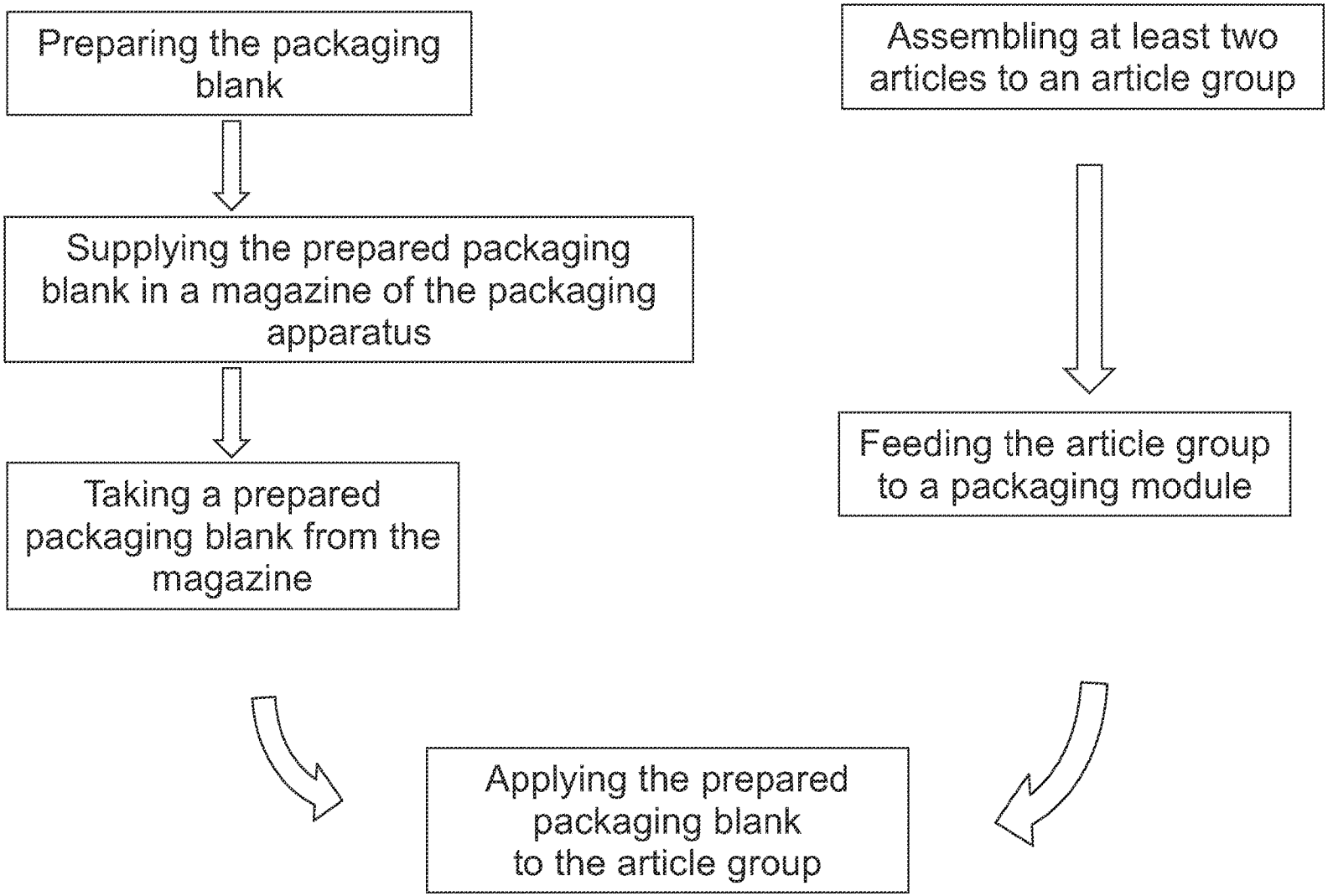
FIG. 13 shows a schematic procedure of another embodiment of a method used to produce packaging units according to the invention.

FIG. 13 schematically illustrates the procedure of another embodiment of a method used to produce packaging units according to the invention. In this context, it is provided that the preparation of the packaging blanks can already be carried out before they are supplied in a magazine of the packaging apparatus.

The preparation of the packaging blanks can already be carried out by the supplier of the packaging blanks. Alternatively, an appropriate pre-treatment module can be assigned to the magazine. This means that in such instances, already prepared packaging blanks are supplied in the magazine to the packaging module of the packaging apparatus. The prepared packaging blanks, in which the resistance force in an edge area of the passage openings of the packaging blanks is reduced, are taken from the magazine and positioned on the articles of the article group in the above described manner.

Figure 14A:
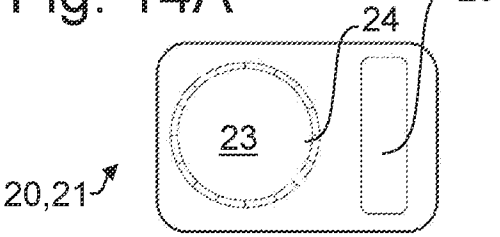
FIG. 14A and FIG. 14B show fourth embodiments of a packaging blank.
Figure 14B:
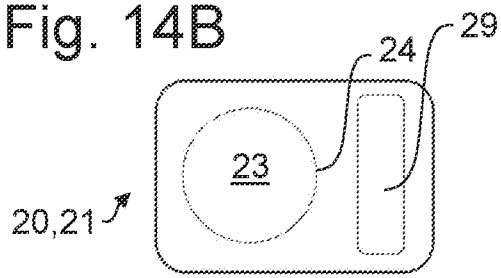
Figure 15:
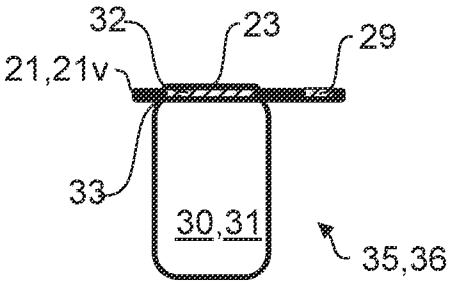
FIG. 15 shows a lateral view of a packaging unit with a packaging blank according to FIG. 14A or FIG. 14B.

FIG. 14A and FIG. 14B show fourth embodiments of a packaging blank 20. FIG. 15 shows a lateral view of a packaging unit 35 with a packaging blank 20 according to FIG. 14A or FIG. 14B. FIG. 1 to FIG. 3, in particular, are referred to regarding the description of the articles 30.

In particular, the packaging blank 20 is a so-called carrying handle blank 21, which has at least some portions or areas that are flat and which has a passage opening 23 in this flat area for the application of the carrying handle blank 21 to the article 30, in particular to the can 31.

Furthermore, the carrying handle blank 21 comprises a so-called carrying handle opening 29 for the user to pass at least one finger through, for example, in order to be able to hold and/or carry and/or transport the article more easily or better. Another suitable carrying element can also be provided instead of the carrying handle opening 29. According to one embodiment of the invention, it can be provided that the carrying element extends beyond the plane of the flat area at least on one side.

As has already been described in connection with FIG. 1 to FIG. 3, it is also provided in this exemplary embodiment that the carrying handle blank 21 is secured to the can 31 below the lid edge 32 in the finished packaging unit 35. It is thereby ensured that the carrying handle blank 21 does not become disengaged from the article 30 or the can 31 when the user uses the carrying handle 29 or the carrying element (not illustrated here) to lift up the packaging unit 35.

Figure 16:
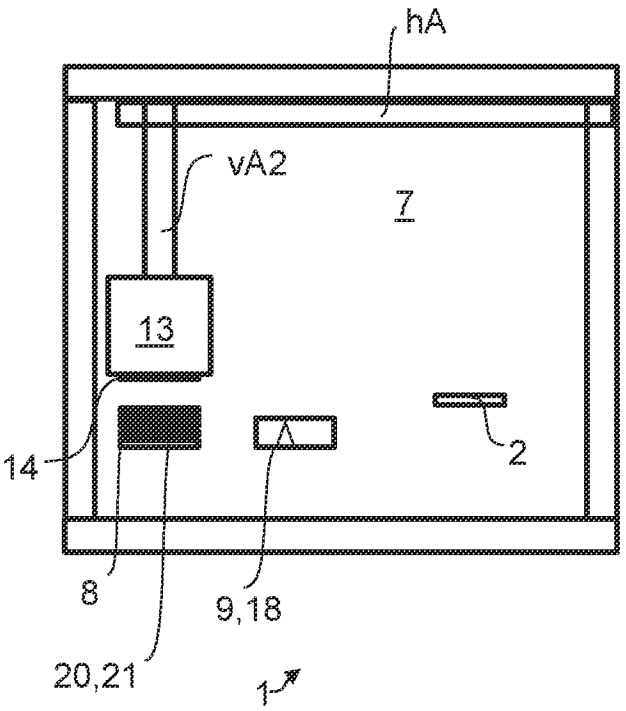
FIG. 16 shows a lateral view of a packaging apparatus used to add a carrying handle blank according to FIG. 14A or FIG. 14B.

FIG. 16 shows a schematic lateral view of a packaging apparatus 1 used to add a carrying handle blank 21 according to FIG. 14A or FIG. 14B. The description of the reference numbers already referred to in connection with FIG. 5 and FIG. 6 is largely dispensed with here; the additionally visible features or differences, however, will be in particular described.

The articles are fed in via a transport device 2. The carrying handle blanks 21 are provisioned in a magazine 8. One carrying handle blank 21 is in each instance taken from the magazine 8 and fed to a pre-treatment module 9 via a suitable gripper head 13 equipped, for example, with at least one vacuum cup 14.

The gripper head 13 is vertically movable via a vertical axis vA2, that is to say, the height of the gripper head 13 can be appropriately adjusted, in particular for taking the provisioned carrying handle blanks 21 from the magazine 8 and for the deposit of the carrying handle blanks 21 in the pre-treatment module 9. The gripper head 13 can furthermore be moved laterally between the magazine 8 and the pre-treatment module 9 via a horizontal axis hA.

The pre-treatment module 9 comprises a suitable stretching tool 18. The pre-treatment of the carrying handle blank 21, in particular in the area of the particular passage opening, is carried out analogous to the manner as already described in detail in connection with FIG. 1 to FIG. 13.

The correspondingly pre-treated carrying handle blank 21*v* is positioned on the article 30 (also cf. FIG. 15). This can be carried out, for example, while the article is being continuously moved along on the transport device 2.

Alternatively, it can be provided that the particular article to which a carrying handle blank 21 is to be added is taken from a transport device 2 and transferred to a handling area (not illustrated here) of the packaging module 7 in which the addition of the carrying handle blank 21 is carried out. Subsequently, the article thus provided with a correspondingly prepared carrying handle blank 21*v* is arranged on a further transport device or arranged on the feeding transport device 2 again and fed to a further handling, for example.

The side views of FIG. 17 to FIG. 20 each schematically illustrate embodiment variants of a packaging line arranged inside a packaging apparatus 1. The packaging apparatus 1 can be equipped with industrial robots, in particular, in which instance gripper heads 11 and/or 13 and/or 15 according to the above definition can continue to be used.

Figure 27:
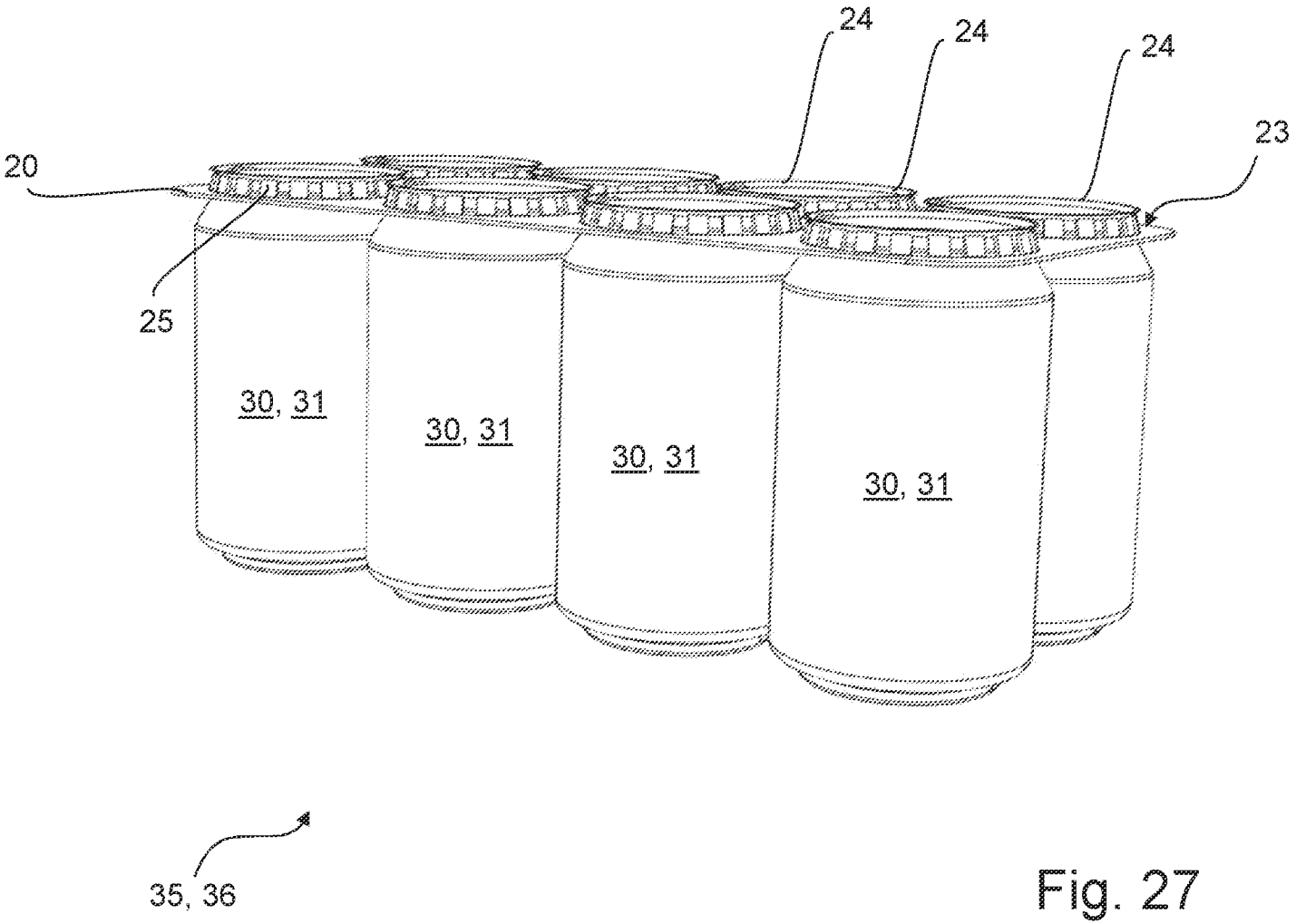
FIG. 27 shows a schematic perspective view of a multipack such as can be produced with various embodiments of the working tool according to the invention.

The packaging apparatus 1 can be used to produce packaging units 35 or packs 36, such as are exemplarily illustrated in FIG. 27, in each instance from assemblies 40 of articles 30 or of article groups 41.

Such a packaging unit 35 or such a pack 36 comprises a plurality of articles 30 or beverage cans 31 and a flat packaging blank 20 via which the plurality of articles 30 or cans 31 are held to each other in a form-locking manner.

The flat packaging blank 20 has an opening 23 assigned to each of the beverage cans 31, which opening 23 the particular beverage can 31 passes through with an upper section such that all beverage cans 31 of the particular pack 36 are held to each other in a form-locking and/or force-locking manner via the flat packaging blank 20.

The embodiment of such a pack 36 as illustrated in FIG. 27 comprises exactly eight beverage cans 31. In other embodiments, it is possible for a pack 36 to comprise only two beverage cans 31, four beverage cans 31, or six beverage cans 31, for example.

In order to assemble or to produce the particular pack 36, the packaging line of the shown packaging apparatus 1 comprises a first module 60, a second module 70, and a transport device 2, which can continue guiding articles 30 or beverage cans 31 from the first module 60 along to the second module 70. In the exemplary embodiment according to FIG. 17, FIG. 18, FIG. 19, and FIG. 20, the second module 70 is downstream in a conveying direction FR provided for the beverage cans 31 from the first module 60.

In order to be able to produce a pack 36 corresponding to the exemplary embodiment according to FIG. 27, beverage cans 31 provided for the particular pack 36 have to be brought into an arrangement relative to each other in which the passage openings 23 of the packaging blank 20 are arranged to be aligned with the beverage cans 31 and the beverage cans 31 can then be pushed in an aligned orientation through the openings 23 of the flat packaging blank 20.

If beverage cans 31 are not appropriately aligned with one another, the beverage cans 31 will not or only partially come in line with the passage openings 23 during a positioning of the packaging blank 20, thereby potentially resulting in problems in a positioning of the particular flat packaging blank 20.

In order to form a particular grouping 41 or assembly 40 from a plurality of beverage cans 31, dividers can be provided, for example, which can comprise two horizontal conveying devices following one another in conveying direction FR and producing groupings 41 in each instance of a plurality of beverage cans 31 by an intermittent operation. Also known are dividers that are able to come into abutment on articles 30 or beverage cans 31 via a plurality of pushing bars, to then accelerate the particular beverage cans 31 in relation to beverage cans 31 succeeding in conveying direction FR, and to hereby form a particular grouping 41 from a plurality of beverage cans 31.

Figure 17:
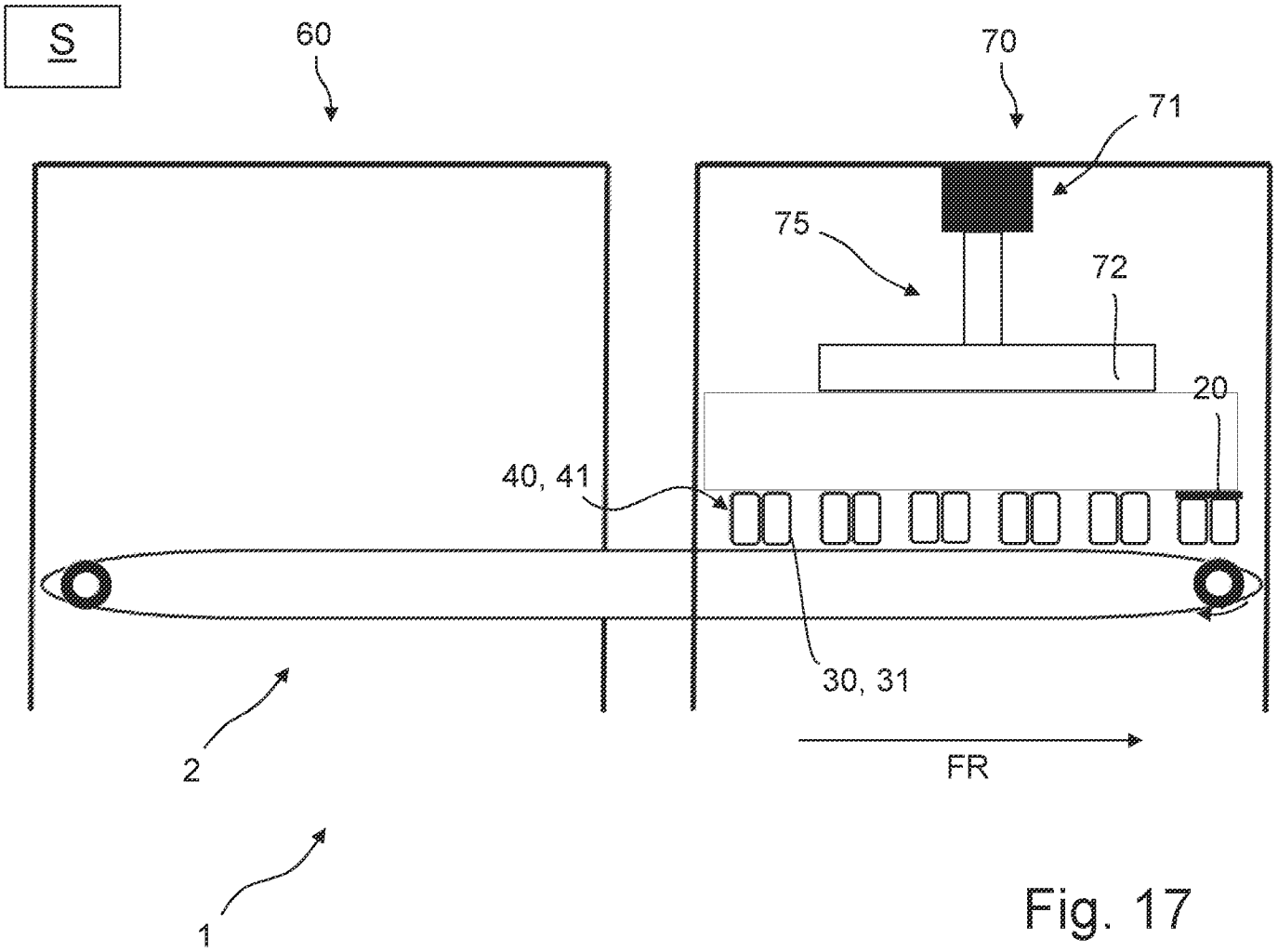
FIG. 17 shows a schematic view of a packaging line in which an embodiment of an industrial robot according to the invention as well as an embodiment of a working tool according to the invention are employed.
Figure 18:
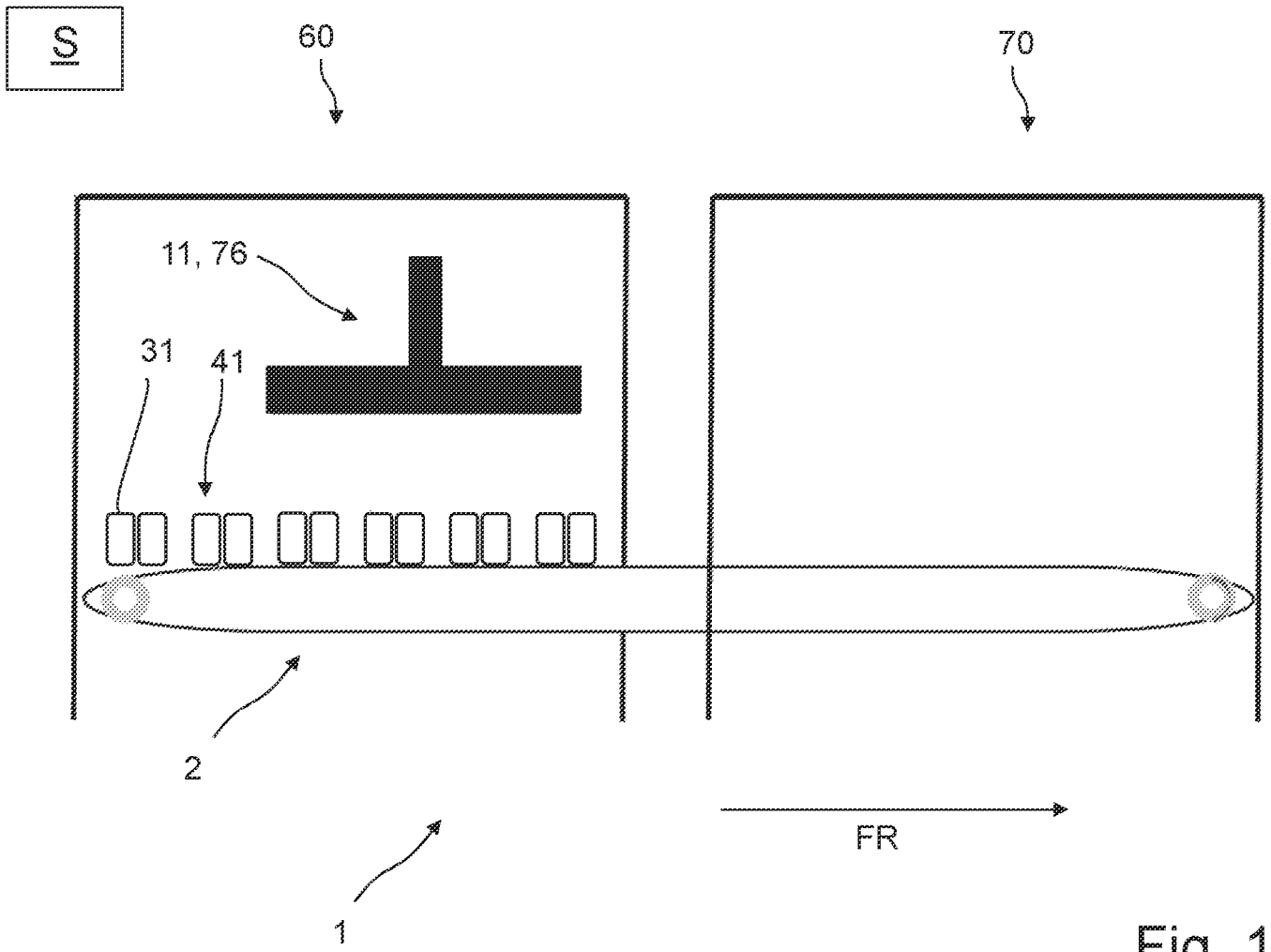
FIG. 18 and FIG. 19 show another embodiment of a packaging line in which an embodiment of an industrial robot according to the invention as well as an embodiment of a working tool according to the invention are employed.

In the packaging apparatus 1 from the exemplary embodiment according to FIG. 17 to FIG. 20, the first module 60 comprises the first gripper head 11 (also cf. FIG. 5 and FIG. 6 in this context), which is schematically illustrated in FIG. 18, in order to produce the groupings 41. In such embodiments, beverage cans 31 are received from a supply unit 61 (cf. FIG. 28) via the first gripper head 11, then moved toward the transport device 2, and deposited on the transport device 2 in a direction coming from above.

The depositing of the beverage cans 31 on the transport device 2 is in this context carried out via a handling device formed by the first gripper head 11 in the range of the first module 60 in such a manner that a grouping 41 of beverage cans 31 is formed on the transport device 2 immediately upon the depositing, with the particular number of beverage cans 31 in each grouping 41 corresponding to the appropriate number of beverage cans 31 in the pack 36 (cf. FIG. 27) to be in each instance produced.

In addition, the depositing of the beverage cans 31 on the transport device 2 via the first gripper head 11 is carried out in such a manner that the beverage cans 31 of a particular grouping 41 formed on the transport device 2 already immediately upon the beverage cans 31 being deposited on the transport device 2 have an alignment relative to one another that is suitable for the positioning of the particular flat packaging blank 20.

As already mentioned above, the first module 60 can also have a divider in order to produce or generate a particular grouping 41 on the transport device 2, which divider is provided instead of the gripper head 11 and which forms the particular groupings 41. In order to be able to receive the beverage cans 31 from the supply unit 61 (cf. FIG. 28) and to deposit them on the transport device 2, the mentioned handling device comprises at least one first gripper head 11.

After the formation of the groupings 41 on the transport device 2, with the groupings 41 each comprising a plurality of beverage cans 31 already aligned relative to one another for the positioning of the flat packaging blanks 20 thereonto, these groupings 41 are moved via the transport device 2 in conveying direction FR.

The transport device 2 is in contact with a control device and/or regulating device S only schematically indicated here, which controls the transport device 2 to provide the groupings 41 deposited thereonto with an interruption-free movement at a same conveying speed or at a conveying speed that is constant in time. The groupings 41 thereupon leave the first module 60 and reach the second module 70 arranged downstream in conveying direction FR from the first module 60.

In order to minimize the risk of the beverage cans 31 inadvertently shifting relative to one another during a movement in conveying direction FR when the beverage cans 31 are already immediately upon being deposited on the transport device 2 suitably aligned relative to one another for the positioning of a flat packaging blank 20, it can be provided that the transport device 2 has a circulating endless traction device or a circulating transport belt with a high static friction formed between the circulating endless traction device or the circulating transport belt and the beverage cans 31. The endless traction device or the circulating transport belt can have a multitude of burls, for example, and/or it can consist of a material that can cause a high static friction to build between the beverage containers and the endless traction device or between the beverage containers and the circulating transport belt.

In order to position the flat packaging blank 20 on a particular grouping 41, the second module 70 preferably comprises an industrial robot 71 carrying a working tool 72, which is merely schematically illustrated in FIG. 17 to FIG. 20. This working tool 72 explained in detail below has also been referred to above as second gripper head 13 and/or as third gripper head 15 (cf. FIG. 6 to FIG. 8 and FIG. 16 in this context).

The industrial robot 71 can be designed as or integrated into a gantry system, for example. It is conceivable for the industrial robot 71 to be designed as a multi-axis robot or as a delta kinematic robot.

Figure 24:
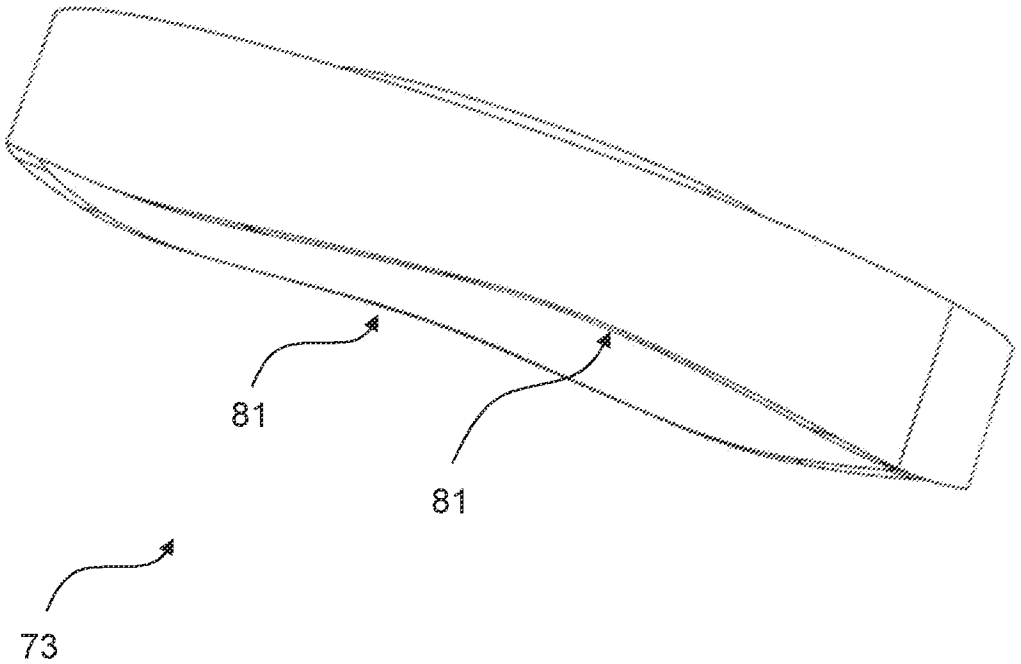
FIG. 24 to FIG. 26 show individual details of a manipulation element of the working tool according to the embodiment of FIG. 18 to FIG. 20.
Figure 25:
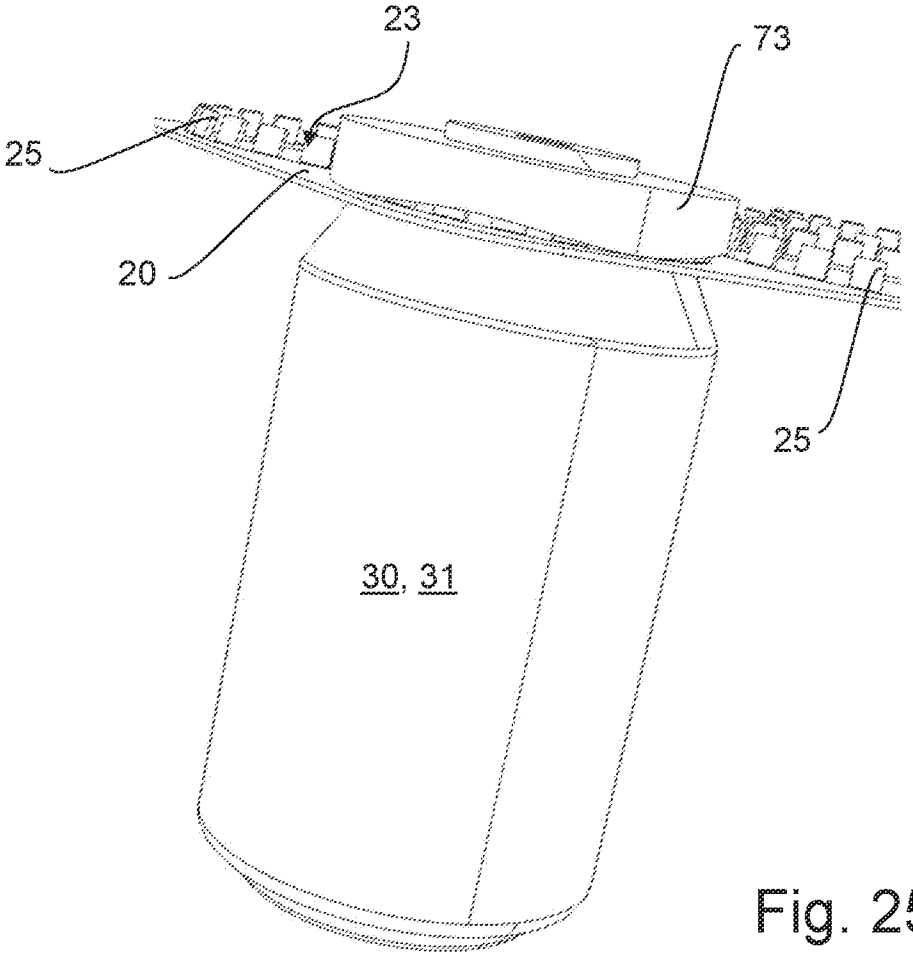
Figure 26:
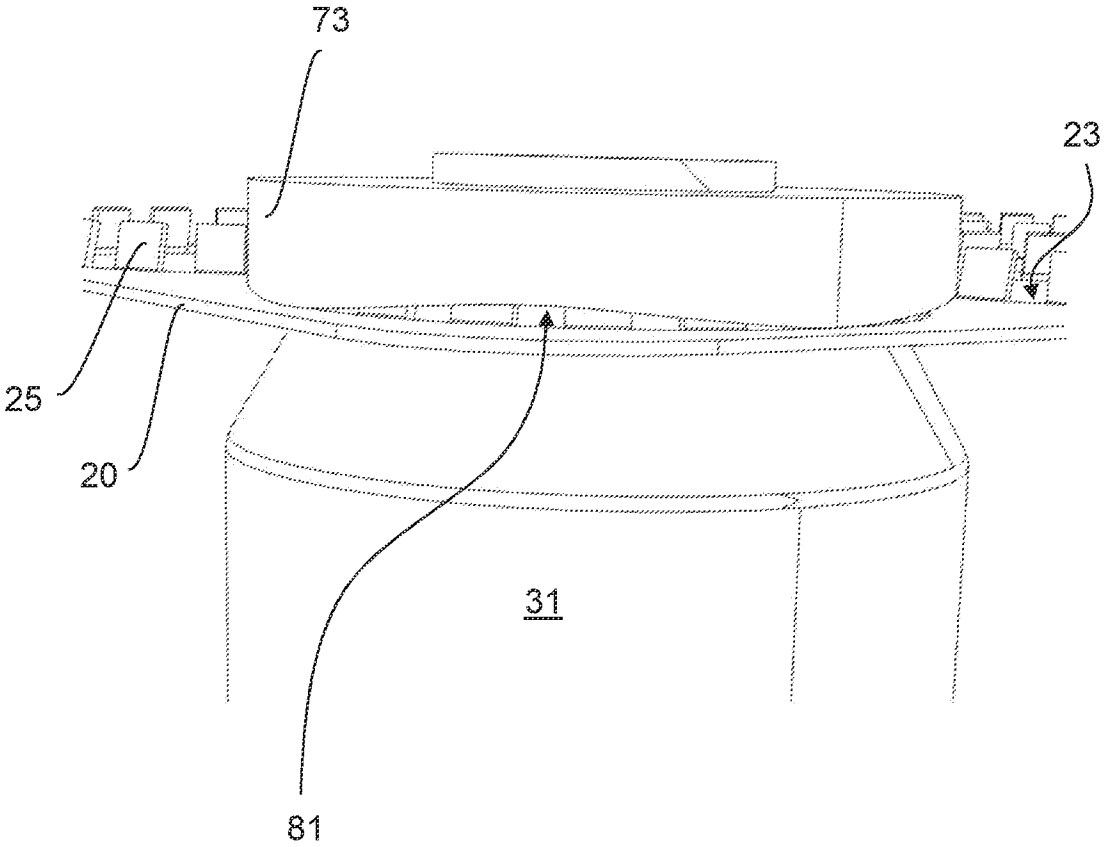

The here so designated working tool 72 comprises a plurality of manipulation elements 73 (cf. FIG. 21) designed in such a manner that the plurality of manipulation elements 73 can apply a particularly defined force along the particular circumferential course of the particular opening 23 onto the flat packaging blank 20 in a temporally offset manner in order to press a particular beverage can 31 into a particular passage opening 23 (cf. FIG. 25 and FIG. 26). The working tool 72 provided in the exemplary embodiment according to FIG. 17 to FIG. 20 can in this instance be designed according to the exemplary embodiment of FIG. 21 to FIG. 26.

The industrial robot 71 can receive a flat packaging blank 20 from a magazine 8 (cf. FIG. 28; also cf. FIG. 5 to FIG. 8 in this context) for each grouping 41 via the working tool 72 according to FIG. 21 to FIG. 26 and also via the working tool 72 according to FIG. 17 to FIG. 20, or, in other embodiments, use the working tool 72 to take off a flat packaging blank 20 from a plurality of dies 74 (cf. FIG. 28) having a plurality of stretching cones 19 (cf. FIG. 7 and FIG. 8) on which the flat packaging blank 20 had been positioned in a preceding process step. Magazine 8 can have a multitude of flat packaging blanks 20 stacked in it.

The industrial robot 71 then aligns the flat packaging blank 20 received by the working tool 72 above the particular beverage cans 31 on which the flat packaging blank 20 is to be positioned. After this, the industrial robot 71 lowers the working tool 72 vertically toward the particular beverage cans 31 or vertically toward the particular grouping 41 and presses the flat packaging blank 20 by force application against the particular beverage cans 31 that are to be gathered together to a pack 36 via the flat packaging blank 20.

Beverage cans 31 hereby pass through openings 23 of the flat packaging blank 20, whereupon the particular beverage cans 31 are held together in a form-locking manner via the flat packaging blank 20 and a pack 36 is formed.

In order to be able to move the working tool 72, the industrial robot 71 preferably has a working arm 75 on which the working tool 72 is arranged. In other embodiments, the working tool 72 can also be designed as a component of or integrated into a gantry system. The working tool 72 can be moved horizontally and vertically, as required, using the working arm 75.

Since in practice a particular diameter of the openings 23 of the flat packaging blank 20 is reduced in relation to a diameter formed in each instance in the upper area by the beverage cans 31, it is possible that the flat packaging blank 20 inadvertently tears in the area of an opening 23 or even in the area of a plurality of openings 23 during a positioning on beverage cans 31. This causes a damage to the pack 36, since it is not possible with a tear in the area of a particular opening 23 to ensure with certainty that a particular can 31 that has been inserted into this opening 23 will still be held securely to the flat packaging blank 20 and will be held together with the other cans 31 of the pack 36. Such a tear also leads to an undesired optical impairment of the pack 36, making it necessary to discharge such a pack 36.

Figure 19:
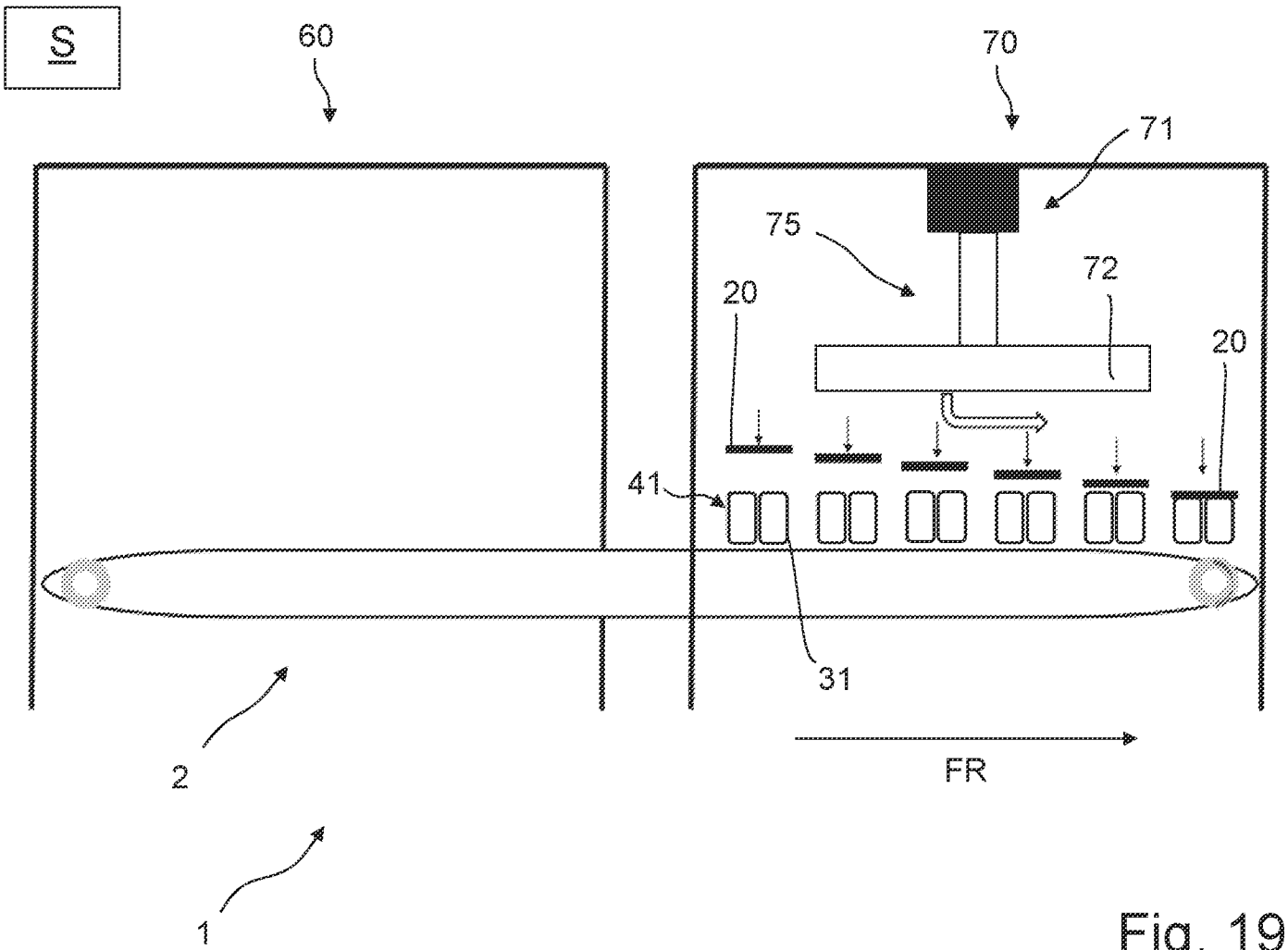
Figure 20:
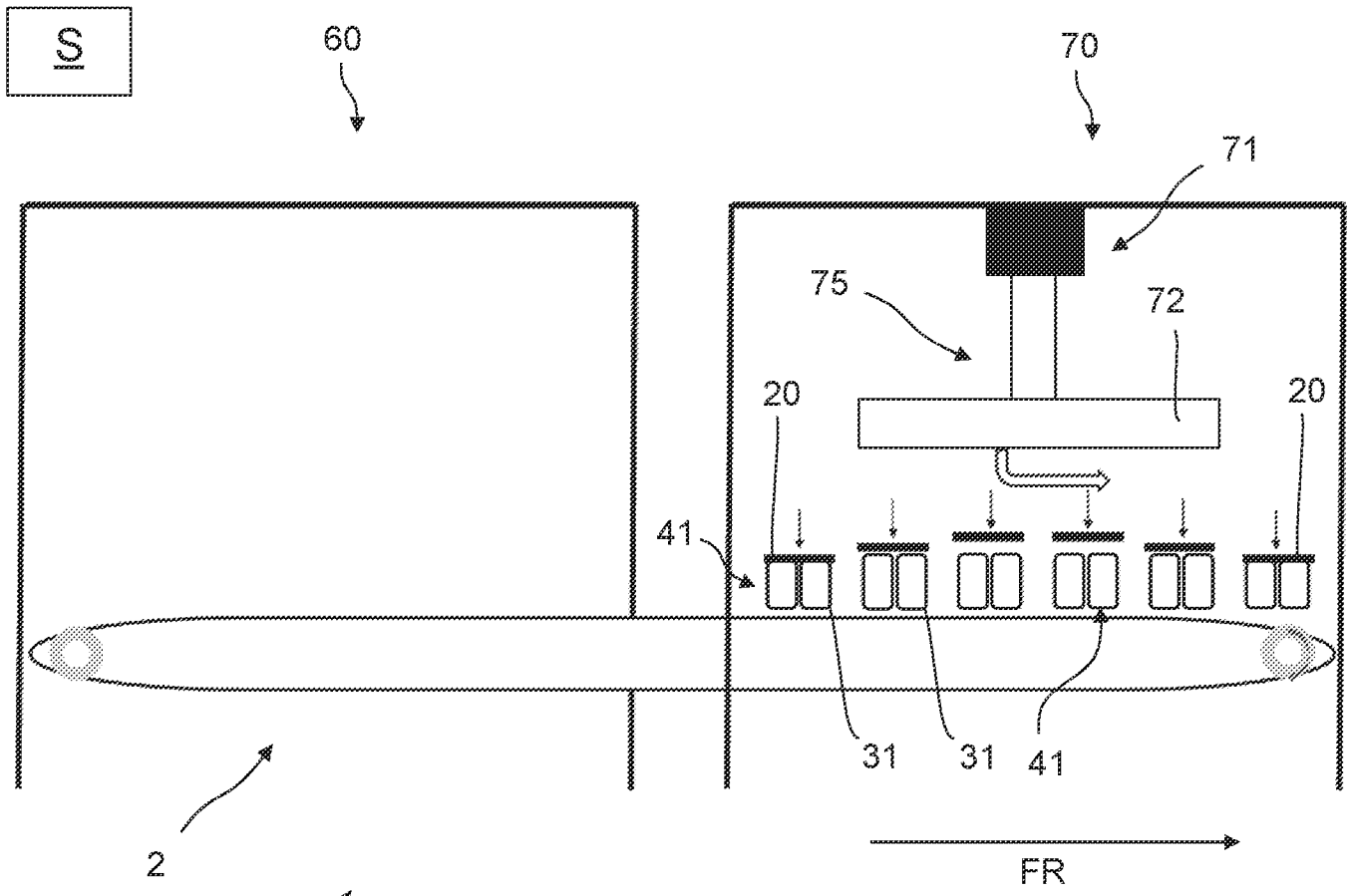
FIG. 20 shows a third embodiment of a packaging line in which an embodiment of an industrial robot according to the invention as well as an embodiment of a working tool according to the invention are employed.
Figure 21:
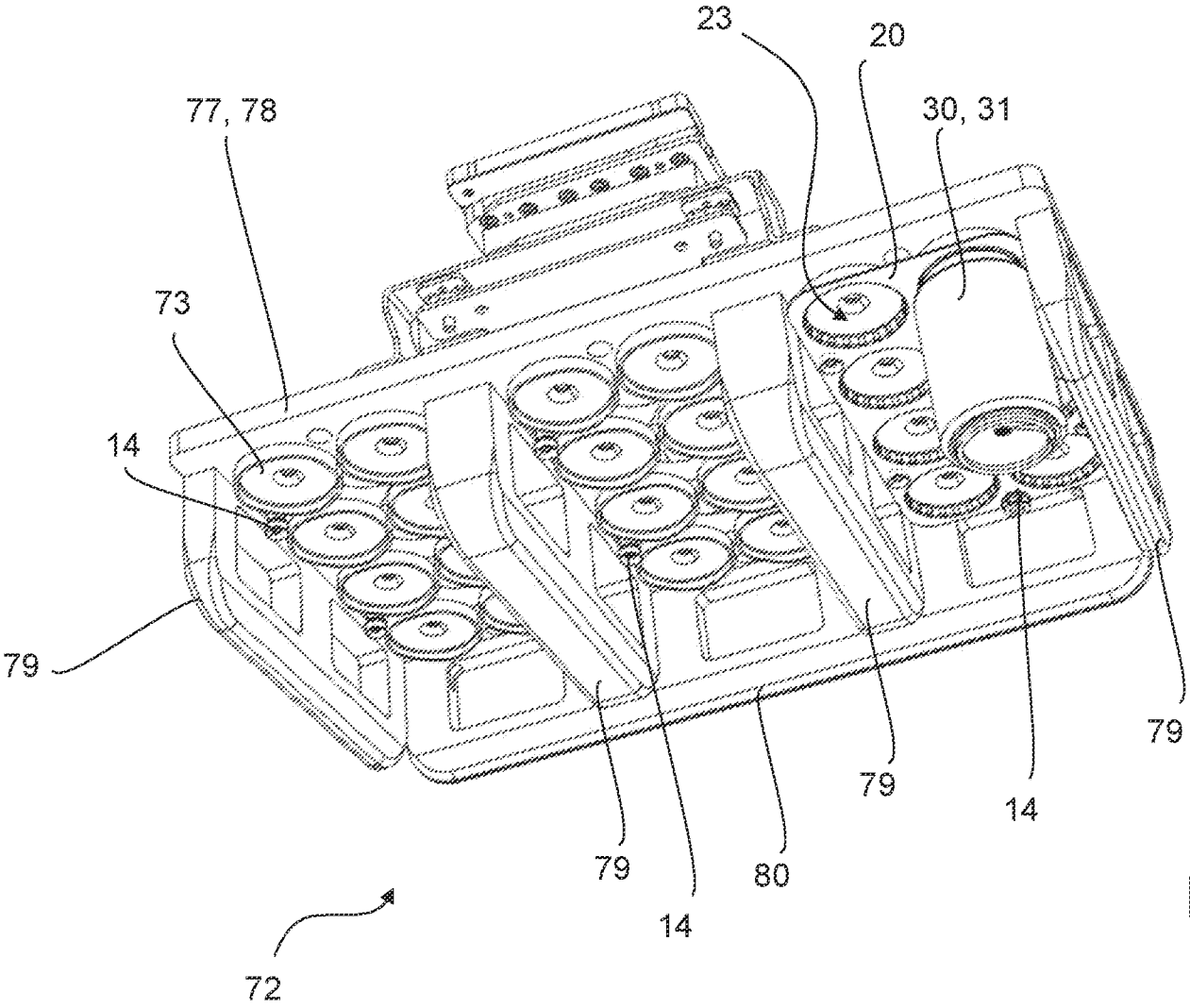
FIG. 21 to FIG. 23 each show a schematic view of an embodiment of a working tool according to the invention.
Figure 22:
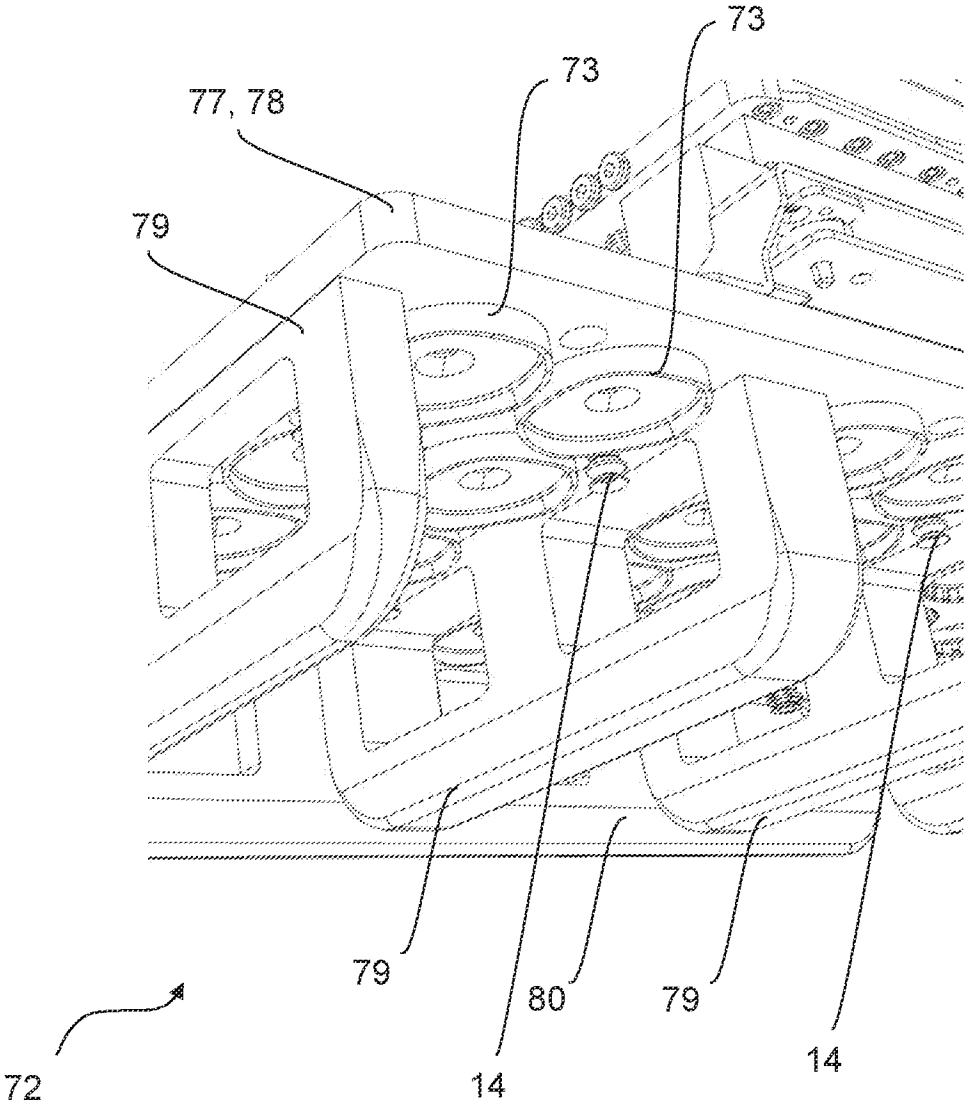
Figure 23:
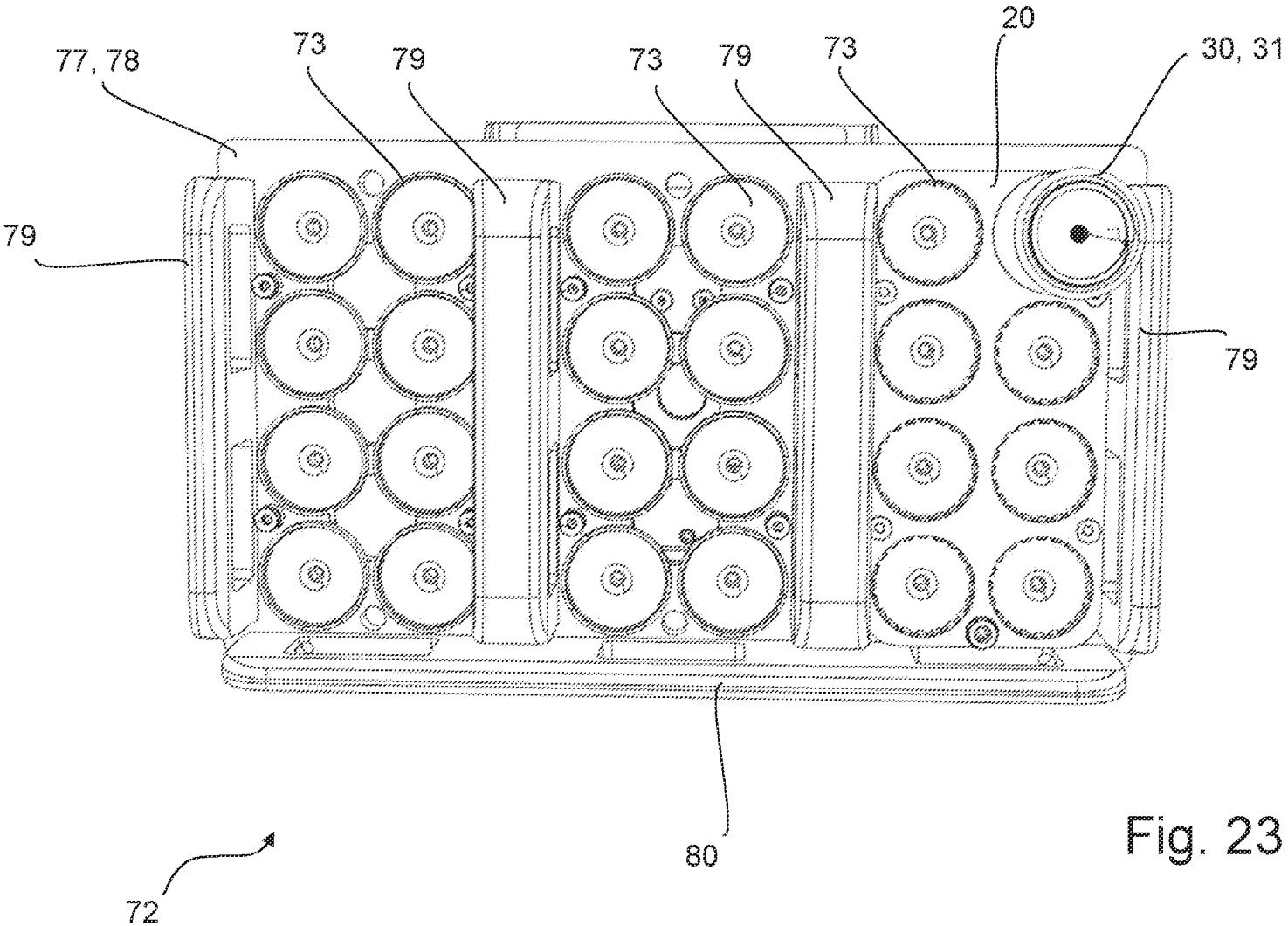

The embodiment of a working tool 72 as provided for the packaging line of the packaging apparatus 1 according to FIG. 17, FIG. 18, FIG. 19, and FIG. 20, as well as an embodiment of a working tool 72 as illustrated in FIG. 21 to FIG. 23 make it possible to reduce a risk of such a tear occurring during a positioning of a flat packaging blank 20 on beverage cans 31.

Practice has even shown that the risk of such a tear occurring during a positioning of a flat packaging blank 20 on beverage cans 31 can be nearly completely excluded by a working tool 72 as provided with the packaging line of the packaging apparatus 1 according to FIG. 17 to FIG. 20 or as shown in the exemplary embodiment according to FIG. 21 to FIG. 23.

The structure and operating mode of the working tool 72 are therefore described in detail below with FIG. 21 to FIG. 23. The preparation of the packaging blanks 20 and **20*v* with the widened and post-treated passage openings 23 and 23*v* has already been described in detail above on the basis of FIG. 7 to FIG. 10**B.

FIG. 18 and FIG. 19 show another embodiment of a packaging line of a packaging apparatus 1 in which an embodiment of an industrial robot 71 according to the invention as well as an embodiment of a working tool 72 according to the invention are employed.

The packaging line of the packaging apparatus 1 from the exemplary embodiment according to FIG. 18 and FIG. 19 can likewise produce numerous packs 36 of the same type, as is exemplarily illustrated in FIG. 27.

In order to assemble or produce the particular pack 27, the packaging line of the shown packaging apparatus 1, as well as the exemplary embodiment according to FIG. 17 comprises a first module 60, a second module 70, and a transport device 2, which can continue guiding articles 30, beverage containers or beverage cans 31 from the first module 60 along to the second module 70. The second module 70 is arranged downstream in conveying direction FR of the horizontal conveying device 2 from the first module 60.

Figure 28:
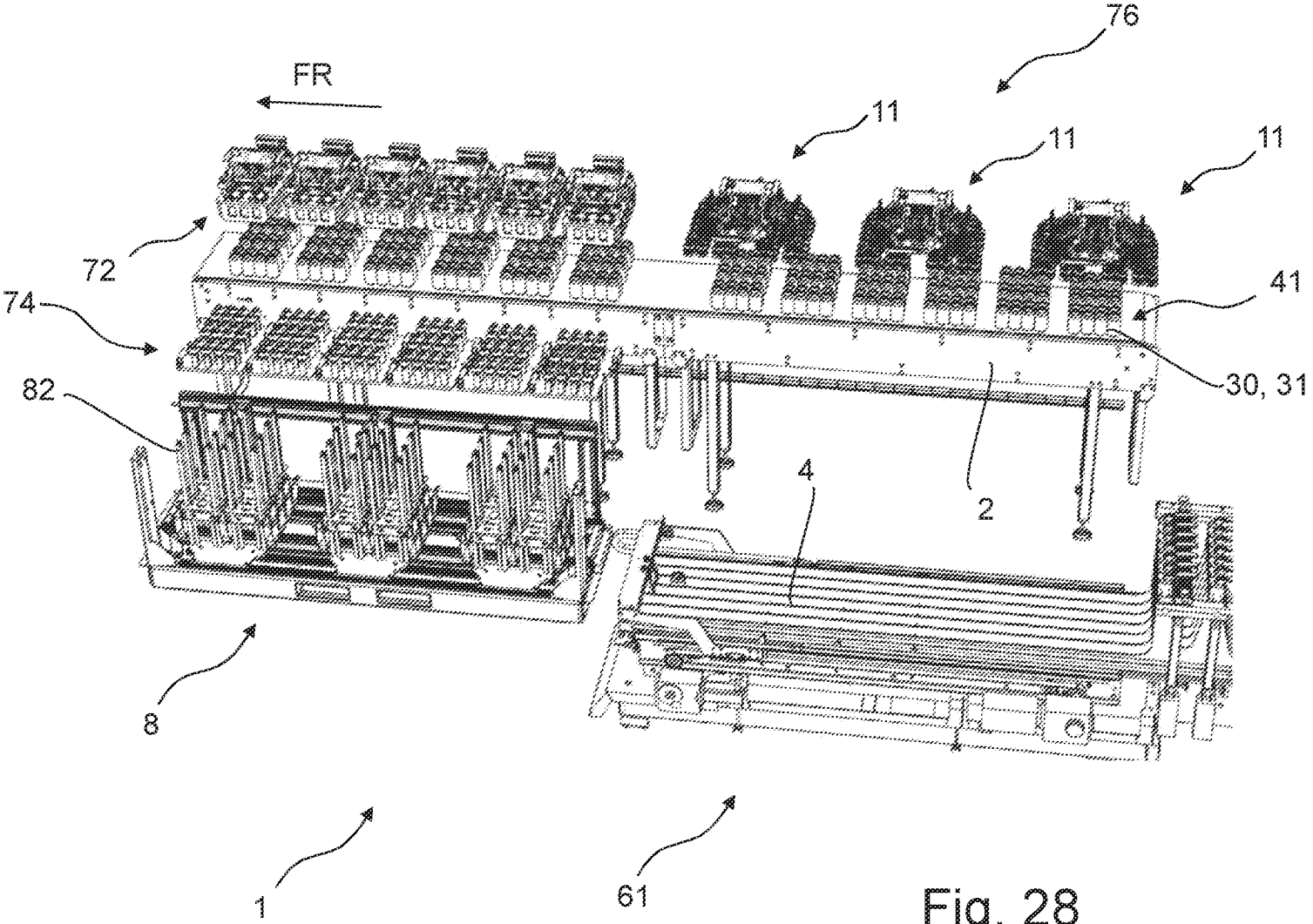
FIG. 28 shows a schematic perspective view of a fourth embodiment of a packaging line in which an embodiment of an industrial robot according to the invention as well as an embodiment of a working tool according to the invention are employed.

In order to be able to ensure that a particular flat packaging blank 20 can be positioned without problems on beverage cans 31 or in order to be able to ensure that the beverage cans 31 of a particular grouping 41 have an alignment relative to one another that is suitable for the flat packaging blank 20 to be positioned thereonto, the first module 60 comprises a handling device 76 with the first gripper head 11 (cf. FIG. 18 and FIG. 28).

Beverage cans 31 are received from a supply unit 61 illustrated in FIG. 28 via the handling device 76 with the first gripper head 11, they are then moved toward the transport device 2, and deposited on the horizontal conveying device 2 in a direction coming from above. The depositing of the beverage cans 31 on the transport device 2 is in this context carried out via the handling device 76 in such a manner that a grouping 41 of beverage cans 31 is formed on the transport device 2 immediately upon the depositing, with the number of beverage cans 31 in each grouping 41 corresponding to the number in the particular pack 36 to be produced (cf. FIG. 27).

In addition, the depositing of the beverage cans 31 on the transport device 2 via the handling device 76 is carried out in such a manner that the beverage cans 31 of a particular grouping 41 formed on the transport device 2 already immediately upon the beverage cans 31 being deposited on the transport device 2 have an alignment relative to one another that is suitable for the positioning of the particular flat packaging blank 20. As it is hereby possible to dispense with a division via holding elements and with a guiding via tracks, there is no risk of the beverage cans 31 being scratched or damaged due to a surface contact with guide rails and/or holding elements.

Temporally after the groupings 41, each comprising a plurality of beverage cans 31 already aligned relative to one another for the positioning of the flat packaging blanks 20 thereonto, have been formed on the transport device 2, the groupings 41 are moved via the transport device 2 in conveying direction FR. The transport device 2 is in contact with a control device and/or regulating device S, which controls the transport device 2 to provide the groupings 41 deposited thereonto with an interruption-free movement at a same conveying speed or at a conveying speed that is constant in time. The groupings 41 thereupon leave the first module 60 and reach the second module 70 downstream in conveying direction FR from the first module 60.

The schematic views of FIG. 18 and FIG. 19 moreover illustrate that an industrial robot 71 carrying a working tool 72 via a working arm 75 in a hanging position is assigned to the second module 70. Via the working tool 72, the industrial robot 71 can be enabled to receive a plurality of flat packaging blanks 20 simultaneously from a stack, which is not illustrated in the figures (for example, from a magazine 8, cf. FIG. 5 to FIG. 8), or from dies 74 (cf. FIG. 28).

After the receiving, the working tool 72 is moved toward the transport device 2 such that the working tool 72 is situated together with the plurality of flat packaging blanks 20, which are up to then still being held by the working tool 72, above the plurality of groupings 41 onto which the flat packaging blanks 20 are to be positioned. The working tool 72 is subsequently lowered toward the groupings 41 and then positions the flat packaging blanks 20 on the groupings 41.

Since the groupings 41 are moved along interruption-free in conveying direction FR by the transport device 2 temporally during the positioning of the packaging blank 20, the working tool 72 is moved along in conveying direction FR together with the groupings 41 temporally after the lowering and up to the complete positioning of flat packaging blanks 20 onto the groupings 41. As soon as all packaging blanks 20 have been positioned on the groupings 41, the beverage cans 31, which each form a component of a particular grouping 41, form a packaging unit 35 or a pack 36 together with the particular flat packaging blank 20, as is exemplarily illustrated in FIG. 27.

In order to position the flat packaging blanks 20 on the groups of articles or groups of cans or on the groupings 41 the flat packaging blanks 20 have to be pressed in the direction toward the particular beverage cans 31 onto the particular beverage cans 31. In order to position each flat packaging blank 20, the working tool 72 accordingly has to apply a defined force onto the particular flat packaging blank 20, which force acts in a downward direction or toward the particular beverage containers 31.

In order to prevent the working tool 72 from having to apply a relatively high total force at a specific point in time, such embodiments have proved successful in which the working tool 72 is designed in terms of function according to the embodiment described in FIG. 21 to FIG. 23.

If required, it can be additionally provided that the working tool 72 positions the flat packaging blanks 20 on the groupings 41 according to FIG. 19 in a temporally offset manner. In the exemplary embodiment of FIG. 19, a flat packaging blank 20 is in this instance first positioned on an article grouping 41 arranged foremost in conveying direction FR of the transport device 2. Temporally thereafter, flat packaging blanks 20 are consecutively positioned on groupings 41, which succeed the grouping 41 arranged foremost in conveying direction FR of the transport device 2.

It is moreover clear from FIG. 19 that there are also no guide rails or holding elements provided or required in the range of the second module 70, which would otherwise extend in conveying direction FR and which would be moved along together with the groupings 41 or have the groupings 41 slide along them. Groupings 41 or beverage cans 31 are thus preferably also not in surface contact with guide rails and/or holding elements at any point or at any time in the range of the second module 70.

The schematic view of FIG. 20 shows a further embodiment of the packaging line of the packaging apparatus 1, in which an embodiment of an industrial robot 71 according to the invention as well as an embodiment of a working tool 72 according to the invention are employed.

The transport device 2 and the first module 60 here are designed corresponding to the exemplary embodiment according to FIG. 18 and FIG. 19, the passages of the description of which are therefore referred to in this context. The embodiment according to FIG. 20 differs from the exemplary embodiment according to FIG. 18 and FIG. 19 in the manner of positioning the flat packaging blanks 20 via the working tool 72.

As has already been mentioned with reference to FIG. 19 and to the corresponding passages of the description for FIG. 19, the flat packaging blanks 20 have to be pressed onto the particular beverage cans 31 in the direction toward the particular beverage cans 31 via the working tool 72.

In order to position each flat packaging blank 20, the working tool 72 thus has to apply a specific force onto the particular flat packaging blank 20, which force acts in a downward direction or toward the particular beverage containers 31. In order to prevent the working tool 72 from having to apply a relatively high force at a specific point in time, the flat packaging blanks 20 are also positioned on the groupings 41 in a temporally offset manner via the working tool 72 in the exemplary embodiment according to FIG. 20. In addition, the working tool 72 is designed in terms of function according to the exemplary embodiment of the following FIG. 21 to FIG. 23.

From FIG. 19 seen in conjunction with FIG. 20, it is clear that the sequence of positioning flat packaging blanks 20 on the groupings 41 differs in the variant according to FIG. 20 from the variant according to FIG. 19. Whereas in the variant shown in FIG. 19, a flat packaging blank 20 is first positioned on a grouping 41 arranged foremost in conveying direction FR of the transport device 2 and the other groupings then follow, in the variant shown in FIG. 20, a particular flat packaging blank 20 is positioned on a grouping 41 arranged foremost in conveying direction FR and at least approximately simultaneously on a grouping 41 arranged hindmost. Only afterward is a particular flat packaging blank 20 positioned on the other groupings 41 situated between the grouping 41 arranged foremost in conveying direction FR and the grouping 41 arranged hindmost in conveying direction FR, as is shown in the variant of FIG. 20.

The positioning of flat packaging blanks 20 is also carried out pairwise for groupings 41 situated between the groupings 41 arranged foremost and hindmost in conveying direction FR such that in each instance two flat packaging blanks 20 are at least approximately simultaneously positioned on in each instance two groupings 41.

In the exemplary embodiment according to FIG. 20, there are also no guide bars or guide rails and/or no holding elements provided in the range of the second module 70, which could otherwise come into abutment on lateral outer surfaces of beverage cans 31. The movement of the beverage cans 31 in the range of the second module 70 is carried out via the transport device 2 without abutment of lateral outer surfaces of the beverage cans 31 on guide rails and/or holding elements.

FIG. 21 to FIG. 23 each show a schematic view of an embodiment of a working tool 72 according to the invention as has been repeatedly explained above.

The perspective view of FIG. 21 in this context illustrates that the working tool 72 has a carrier 77, which is designed as carrier plate 78 and to which a plurality of manipulation elements 73 are fastened in a hanging position. In the instance of the working tool 72 being moved by an industrial robot 71, the carrier 77 or the carrier plate 78 continuously remains in a horizontal orientation.

The working tool 72 has an own manipulation element 73 for all articles 30 formed by beverage cans 31 of a particular pack 36 to be produced, which manipulation element 73 is in each instance shown in detail in terms of its constructional design in FIG. 24 to FIG. 26, and which manipulation element 73 comes into surface contact by force application with the flat packaging blank 20 upon a positioning of the flat packaging blank 20 on beverage cans 31.

As is illustrated in FIG. 21 to FIG. 23, it is possible to position three flat packaging blanks 20 at least approximately simultaneously on beverage cans 31 via the working tool 72 such that a plurality of beverage cans 31 are at least approximately simultaneously gathered together in three packs 36 by three flat packaging blanks 20 via the working tool 72.

An alternative arrangement of manipulation elements 73 on different height levels moreover provides the possibility of positioning flat packaging blanks 20 on different groupings 41 according to FIG. 19 and FIG. 20 in a temporally offset manner. In such embodiments, manipulation elements 73 assigned to a first flat packaging blank 20 can thus be arranged on different height levels or can have a different relative spacing from the carrier 77 in comparison to manipulation elements 73 assigned to a second flat packaging blank 20.

It is moreover discernible from the perspective view according to FIG. 21 that the working tool 72 comprises a plurality of side partitions 79 as well as a rear wall 80. The side partitions 79 and the rear wall 80 are oriented perpendicular to each other. The side partitions 79 and the rear wall 80 are also each arranged in a hanging position to the carrier 77 or to the carrier plate 78, with the manipulation elements 73 also each being carried in a hanging position by the carrier 77 or by the carrier plate 78.

In this context, the spacing between two adjacent side partitions 79 is selected in such a manner that a particular flat packaging blank 20 can be arranged in a form-locking manner or with slight clearance between two adjacent partitions 79. The rear wall 80 determines a position in a further spatial direction for a flat packaging blank 20 arranged between adjacent partitions 79. A flat packaging blank 20 can therefore in each instance be in abutment on the rear wall 80 as well as on two adjacent side partitions 79, or it can be merely slightly spaced apart from the side partitions 79 or slightly spaced apart from the rear wall 80.

Since the side partitions 79 and the rear wall 80 disable a relative movement of a received flat packaging blank 20 in relation to the manipulation elements 73 in a plurality of spatial directions, it can be ensured with a high degree of certainty that the manipulation elements 73 come in line precisely with a specified position of the flat packaging blank 20 on the particular grouping 41 during a positioning of the flat packaging blank 20.

The side partitions 79 moreover have a further function, as becomes clear from FIG. 17 and FIG. 21 seen in conjunction. As mentioned above, groupings 41 are formed from beverage cans 31 in the range of the first module 60, with these formed groupings 41 being moved spaced apart from one another in conveying direction FR via the transport device 2 and in the process reaching the range of the second module 70.

In order to be able to position flat packaging blanks 20 precisely on the groupings 41 such that the beverage cans 31 each come in line with the openings 23 provided for them, it is necessary for a relative spacing formed between consecutive groupings 41 to correspond very precisely to a specified target spacing. In the instance of a beverage can 31 inadvertently shifting out of place during the movement via the transport device 2 or during the dividing of the beverage cans 31 into groupings 41, it is possible that this beverage can 31 comes to be situated too close to a preceding grouping 41 or too close to a succeeding grouping 41.

In order to correct such errors or in order to then shift the beverage can 31 into a position in which the beverage can 31 comes in line precisely with a particular opening 21 during a positioning of the flat packaging blank 20, the particular beverage can 31 is shifted via the side partitions 79, as required.

As is discernible from FIG. 21, FIG. 22, and FIG. 23, the side partitions 79 each taper in the direction away from the carrier 77. To position the flat packaging blank 20, the working tool 72 is moved toward the beverage cans 31 or toward the particular groupings 41, with the side partitions 79 in this context dipping into a free space formed between consecutive groupings 41. If an inadvertently shifted beverage can 31 or a beverage can 31 the position of which does not correspond to a target position is situated in this free space, a side partition 79 pushes this beverage can 31 back into an intended target position.

Hereby, the beverage cans 31 come in line precisely with the openings 23 of the flat packaging blank 20, whereby the risk of a tear occurring in the flat packaging blank 20 while the beverage cans 31 are being pressed into the openings 23 can be additionally reduced.

The design of the side partitions 79 tapering in the direction away from the carrier 77 has moreover proved successful in preventing damage to the beverage cans 31 during a contact with the side partitions 79 as well as in preventing an overturning of the beverage cans 31 while they are being pushed.

In order to be able to take a flat packaging blank 20 from a magazine 8 (cf. FIG. 28) and to then move the extracted flat packaging blank 20 toward the groupings 41, and in order to be able to firmly hold the particular flat packaging blank to the working tool 72 while the packaging blank 20 is being moved toward the groupings 41 and until it is positioned on a particular grouping 41, the working tool 72 comprises a plurality of suction instruments 14, which have already been referred to as vacuum cups 14 and explained above (cf. FIG. 6 to FIG. 8 in this context).

The suction instruments 14 or vacuum cups are each impingeable with negative pressure or they can secure flat packaging blanks 20 to the working tool 72 using negative pressure. For this purpose, the working tool 72 comprises a plurality of such suction instruments 14 for each flat packaging blank 20 to be received such that the particular flat packaging blank 20 can be securely held to the working tool 72 via the particular plurality of suction instruments 14.

The suction instruments 14 are illustrated in enlargement in FIG. 22. FIG. 22 also shows an enlarged illustration of the carrier 77 or of the carrier plate 78 with the manipulation elements 73, the side partitions 79, and the rear wall 80 each fastened thereto in a hanging position. As already explained above, the manipulation elements 73 assigned to a first flat packaging blank 20 can be arranged on different height levels or can be situated at a different relative spacing from the carrier 77 or from the carrier plate 78 in comparison to further manipulation elements 73 assigned to a second flat packaging blank 20.

From the perspective view onto the working tool 72 from below according to FIG. 23, it is discernible that the side partitions 79 are oriented parallel to one another. A flat packaging blank 20 held by the working tool 72 between two side partitions 79 is illustrated on the right side in FIG. 23. The flat packaging blank 20 already forms a particular opening 23 for each beverage can 31, into which opening 23 the particular beverage can 31 can be inserted or pressed. A beverage can 31, which is already pressed into an opening 23 of the flat packaging blank 20 via the working tool 72 and which is now located to the flat packaging blank 20, is illustrated for clarification in FIG. 23.

In the embodiments illustrated here, the flat packaging blank 20 forms an opening 23 assigned to each beverage can 31 of a particular grouping 41 already during the positioning of the packaging blank 20 on the particular grouping 41. In other embodiments, however, it is also possible that an area in each instance provided in the flat packaging blanks 20 to form the openings 23 is pre-punched and that the openings 23 are not formed before the flat packaging blank 20 is positioned on the beverage cans 31. In this instance, the beverage cans 31 can be guided against the pre-punched area by force application, in which context the pre-punched area is at least partially separated out of the flat packaging blank 20, and openings 23 are hereby created in the flat packaging blank 20. Such embodiments of a flat packaging blank 20 can also be positioned on a plurality of beverage cans 31 by the embodiment of a working tool 72 according to FIG. 21 to FIG. 23.

The perspective view of FIG. 24 illustrates an embodiment of a manipulation element 73. The manipulation element 73 is a component of the embodiment of the working tool 72 according to FIG. 21 to FIG. 23, but it can also be used in a general context independently of this embodiment or it can be a component of other embodiments.

The manipulation element 73 shown in FIG. 24 comprises a contact surface 81, which is brought into surface contact with the flat packaging blank 20 by force application in order to press a beverage can 31 into an assigned opening 23. The contact surface 81 has a curved design.

From FIG. 24 seen in conjunction with FIG. 25, it is moreover clear that the contact surface 81 of the manipulation element 73 does not entirely abut on the flat packaging blank 20 or only abuts on the flat packaging blank 20 in some areas immediately upon coming into contact with the flat packaging blank 20. When the manipulation element 73 is moved starting from its position in FIG. 25 closer toward the beverage can 31, the contact surface 81 of the manipulation element 73 comes into contact with the flat packaging blank 20 along the entire circumferential course of the opening 23 formed in the particular flat packaging blank 20 at a specific point in time due to an elastic deformation of the flat packaging blank 20 in the area immediately around a particular passage opening 23 and then presses the beverage can 31 through the opening 23 up to the point where the beverage can 31 is held firmly to the flat packaging blank 20.

Due to the curved design of the contact surface 81, a force necessary to press a particular beverage can 31 into a particular opening 23 is applied to the flat packaging blank 20 along the circumferential course of the opening 23 in a temporally offset manner. In the beginning of a beverage can 31 being pressed into a particular opening 23, the manipulation element 73 thus first comes into surface contact with the flat packaging blank 20 at a plurality of areas offset along the circumferential course of the particular opening 23.

Only during the further pressing of the particular beverage can 31 into the particular opening 23 is an area with which the manipulation element 73 comes into abutment on the flat packaging blank 20 via the contact surface 81 areally enlarged, whereby the risk of an inadvertent tearing of the flat packaging blank 20 in the area of the particular opening 23 can be kept very low.

Apart from the curved profile of the contact surface 81 exemplarily shown here, there are further embodiments for the forming of the contact surface 81 of the manipulation element 73, in which the force necessary to press a particular beverage can 31 into a particular opening 23 can be applied to the flat packaging blank 20 along the circumferential course of the opening 23 in a temporally offset manner. For example, the contact surface 81 can be formed in a rectilinear manner in this context, and it can be in a slanted position in relation to the flat packaging blank 20.

Such embodiments have also proved successful in which the manipulation elements 73 designed as a component of a working tool 72 are rotated in order to apply a force, which is provided for pressing a particular beverage can 31 into a particular opening 23, in a temporally offset manner. In this instance, an axis of rotation can extend along a longitudinal axis of the particular beverage can 31. The design of the contact surface 81 of the particular manipulation element 73 in this context can still be formed in a curved manner or can be in a slanted position in relation to the flat packaging blank 20.

The enlarged view of FIG. 26 once more shows individual aspects of the illustration of FIG. 25 in detail or in enlargement. The curved profile of the contact surface 81 of the manipulation element 73 is again discernible. FIG. 26 also shows that the flat packaging blank 20 has a plurality of securing tabs or retaining tabs 25 (for the securing tabs or retaining tabs also cf. FIG. 25) in the area of a particular opening 23. A particular beverage can 31 moreover forms an upper edge 24 or a seam (cf. FIG. 27) extending around a closure (not illustrated in the figures) of a particular beverage can 31.

Temporally after a particular beverage can 31 has been pressed into a particular opening 23, the retaining tabs or securing tabs 25 are in each instance arranged below the particular upper edge 24, and they secure the flat packaging blank 20 to the particular beverage can 31 so as to be immovable in axial direction. In order to keep a force necessary to press the beverage cans 31 into the openings 23 at a low level, embodiments have proved successful in which the retaining tabs 25 are pre-bent temporally before the beverage cans 31 are pressed into the openings 31 or transferred to an upright orientation according to FIG. 25.

FIG. 27 shows a schematic perspective view of a packaging unit 35 or a pack 36 as can be produced with various embodiments of the working tool 72 according to the invention. The pack 36 in the present context comprises precisely eight beverage cans 31, which are held to each other via a flat packaging blank 20. For this purpose, the beverage cans 31 have been pressed into the openings 23 of the flat packaging blank 20 by a working tool 72 (cf. FIG. 21 to FIG. 23), whereby the retaining tabs or securing tabs 25 are arranged below the upper edges 24, which retaining tabs 25 secure the flat packaging blank 20 to the beverage cans 31 so as to be immovable in axial direction.

FIG. 28 shows a schematic perspective view of a further embodiment of a packaging apparatus 1 according to the invention, in which an embodiment of an industrial robot 71 according to the invention as well as an embodiment of a working tool 72 according to the invention are employed. The industrial robot 71 can be designed as a gantry system or as a multi-axis robot, for example, and, for the purpose of clarity, it is not illustrated in FIG. 28.

The packaging line of the packaging apparatus 1 comprises a supply unit 61 which transports beverage cans 31 in a plurality of parallel rows. For the transport in a plurality of parallel rows, the supply unit 61 has a plurality of guide rails or lane guides 4, with a single-row stream of beverage cans 31 being moved between immediately adjacent guide rails or lane guides 4.

The embodiment of FIG. 28 moreover comprises a transport device 2 which moves beverage cans 31 deposited thereon in conveying direction FR. The conveying direction FR and the movement direction in which the supply unit 61 transports beverage containers 31 in a plurality of parallel rows or lanes 3 are oriented parallel to one another.

The packaging apparatus 1 furthermore comprises a handling device 76 with a plurality of gripper heads 11 via which the handling device 76 can receive beverage cans 31 being moved in parallel rows or lanes 3 via the supply unit 61 and can deposit the beverage cans 31 as a grouping 41 on the transport device 2. In the packaging line of the packaging apparatus 1 of FIG. 28, it is also provided that the beverage cans 31 of a particular grouping 41 already immediately upon being deposited on the transport device 2 have an alignment relative to one another that is intended or suitable for the positioning of the particular flat packaging blank 20.

In order to be able to position flat packaging blanks 20 on the groupings 41 each comprising a plurality of beverage cans 31, the packaging apparatus 1 has six working tools 72 in the present instance. The working tools 72 in this context can have a structure corresponding to the embodiment previously described with FIG. 21 to FIG. 23, and they can position flat packaging blanks 20 on groupings 41, as has already been explained above in the description for FIG. 21 to FIG. 23.

The packaging apparatus 1 furthermore comprises a magazine, 8 which picks up and keeps ready the packaging blanks 20 that have not yet been positioned on groupings 41. For this purpose, the magazine 8 comprises a plurality of vertically aligned tines 82, for example, with a particular tine 82 gripping through the particular opening 23 of a particular flat packaging blank 20 picked up in the magazine 8. The flat packaging blanks 20 are thus held in the magazine 8 by the tines 82.

In practice, it is possible that the working tools 72 have to apply a relatively high force in order to position a particular flat packaging blank 20 on a particular grouping 41. In consideration of the pack 36 according to FIG. 27, it is discernible here that an upper edge 32 of a particular beverage can 31 has to be inserted through a particular opening 23 if a particular flat packaging blank 20 is to be positioned on a particular grouping 41. Since the flat packaging blank 20 has to be elastically deformed in this process, it is possible that individual or several beverage cans 31 will be inadvertently overturned when the packaging blank 20 is positioned on a particular grouping 41. This force can already be reduced in terms of amount by the manipulation elements 73, which are in each instance a component of the working tools 72.

In order to further reduce a resistance force of the flat packaging blanks 20 in the area of the openings 23, the flat packaging blanks 20 are first placed on dies 74 in the packaging apparatus 1 according to FIG. 28, with a particular die 74 dipping into a particular opening 23 of a particular flat packaging blank 20. In their function, the here so designated dies 74 thus correspond to the stretching cones 19 already explained above with reference to FIG. 6 to FIG. 8 and the dies 74 can also resemble the stretching cones 19 or correspond to them in design.

It is possible in this context that the working tools 72 take a particular flat packaging blank 20 from the magazine 8, dip the dies 74 or stretching cones 19 temporally hereafter into the openings 23 of the particular packaging blank 20, and then elastically deform or stretch a particular edge area 24 of a particular opening 23 by the dies 74 (in this context cf. FIG. 7 to FIG. 10B and the corresponding passages of the description) such that the resistance force to be overcome in order to position the flat packaging blank 20 on a particular grouping 41 is hereby reduced.

Figure 29:
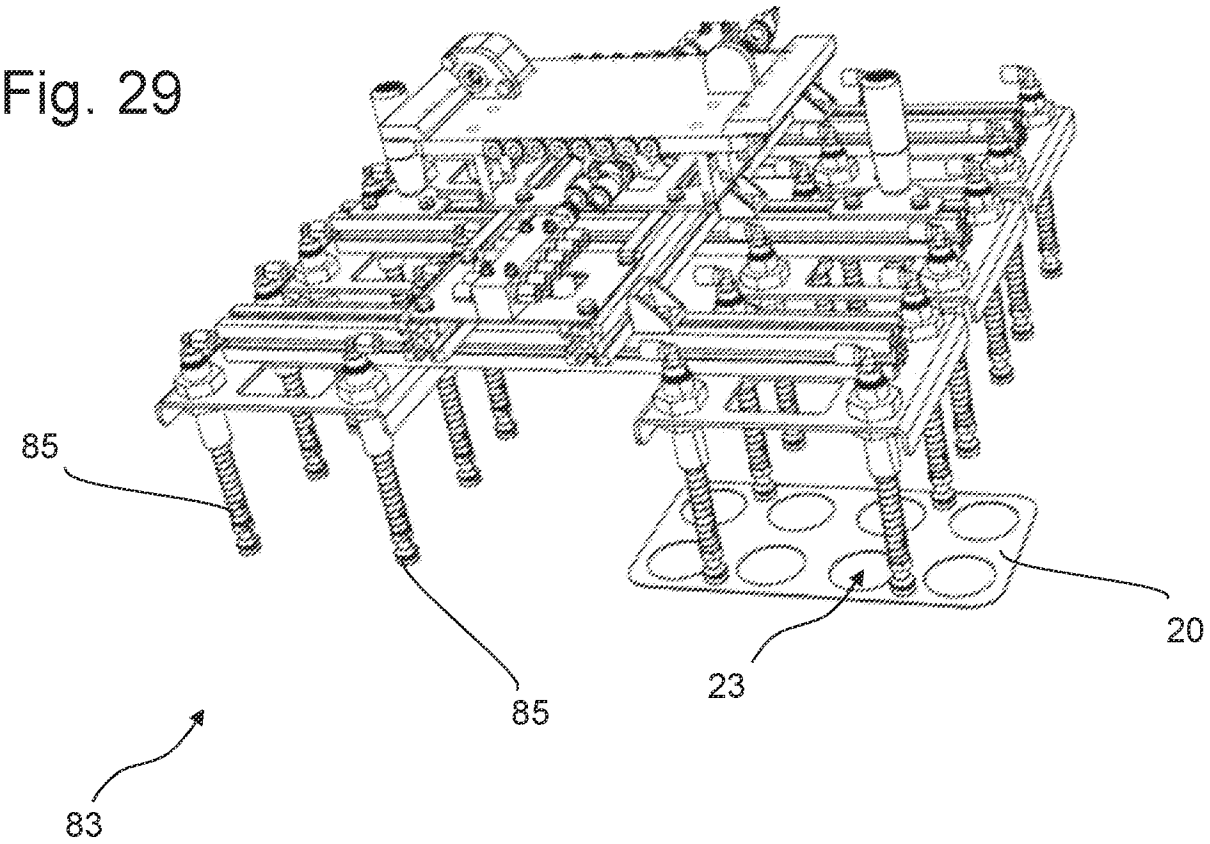
FIG. 29 to FIG. 31 show individual details of an embodiment of a packaging line according to FIG. 28.

In the embodiment according to FIG. 28 it is provided, however, that a transfer tool 83 illustrated in detail in FIG. 29 takes a particular flat packaging blank 20 from the magazine 8 and then places it on the dies 74 such that a particular die 74 is dipped into a particular opening 23 of a particular flat packaging blank 20. The transfer tool 83 then leaves the close vicinity of the dies 74 and is returned toward the magazine 8.

In temporal overlap with the movement of the transfer tool 83 toward the magazine 8, the working tools 72 are moved toward the flat packaging blanks 20 having been placed onto the dies 74 and then come into contact with the dies 74 still positioned on the flat packaging blanks 20. The flat packaging blanks 20 are hereupon pressed downward onto the dies 74 via the working tools 72, whereby edge areas 24 of the openings 23 are stretched.

In the following, the working tools 72 take the flat packaging blanks 20 off the dies 74, move the flat packaging blanks 20 taken off of the dies 74 toward the groupings 41 arranged in the transport device 2, and then position the flat packaging blanks 20 on the groupings 41. Since edge areas 24 of the openings 23 were previously stretched by the dies 74, a resistance force that has to be overcome in order to position the flat packaging blanks 20 on groupings 41 is significantly reduced in comparison to embodiments without such a previous stretching of the edge areas 24.

As already mentioned above, the flat packaging blanks 20 are placed on the dies 74 by a transfer tool 83, with a particular die 74 dipping into a particular opening 23 of a particular flat packaging blank 20. The number of dies 74 thus has to correspond at least to the number of openings 23 formed by the flat packaging blanks 20. In order for the dies 74 to be able to dip into the openings 23, the arrangement or the position of the dies 74 has to be adjusted to the particular arrangement or to the position of the openings 23 formed by the flat packaging blanks 20.

In order to produce different packs 36 (in terms of size, arrangement, etc.), it is possible that flat packaging blanks 20 are required for this purpose that are different with regard to the particular number of the openings 23 and/or with regard to their particular position or to their arrangement in the flat packaging blank 20. It can thus be necessary to exchange the dies 74 if different packs 36 are intended to be produced by the packaging apparatus 1 in temporally consecutive packaging processes.

In order to be able to accomplish such an exchange of dies 74 in a quick and uncomplicated manner, a plurality of dies 74 are gathered together to a particular format part 84 (cf. FIG. 31) in the embodiment according to FIG. 28. If flat packaging blanks 20 are replaced in the packaging apparatus 1 for flat packaging blanks 20 which differ with regard to number and/or arrangement of the openings 23, format parts 84 are exchanged, which format parts 84 in each instance comprise a plurality of dies 74. The exchange of format parts 84 comprising a plurality of dies 74 can be carried out by a user, for example, or in an automated manner by a correspondingly equipped and correspondingly controllable industrial robot.

There are also embodiments in which format parts 84 comprising a plurality of dies 74 can be exchanged by a driverless transport system, if required.

Figure 30:
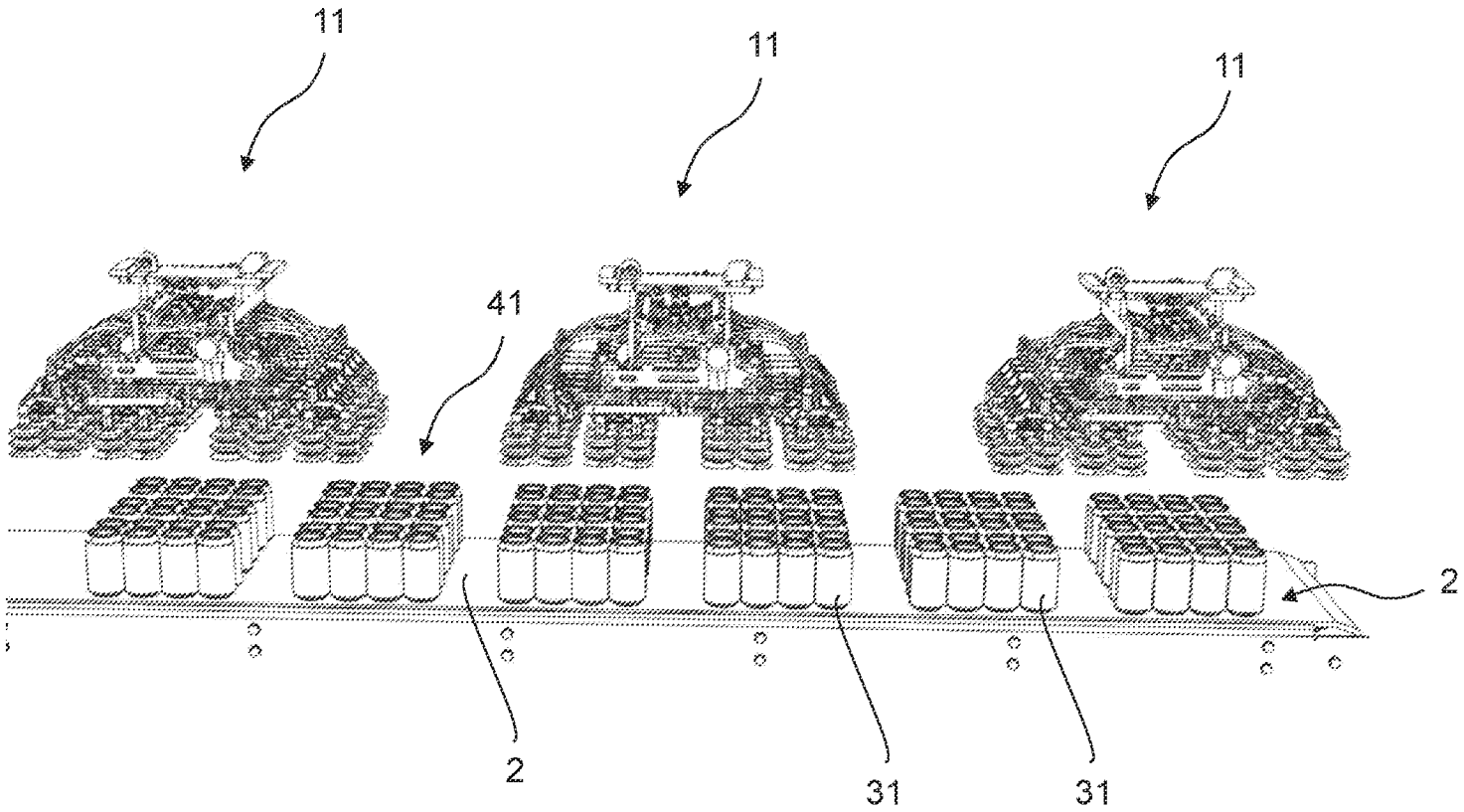

FIG. 29 and FIG. 30 show individual details of an embodiment of a packaging apparatus 1 according to FIG. 28. FIG. 29 here shows the previously mentioned transfer tool 83, which can take flat packaging blanks 20 from a magazine 8 and position them on the dies 74. The transfer tool 83 has four supporting tappets 85 assigned to each flat packaging blank 20, which supporting tappets 85 are each spring-mounted and can suction and seize a particular flat packaging blank 20 in a pneumatic manner, that is, by vacuum-controlled seizing and receiving.

FIG. 30, in particular, once more shows the gripper heads 11 already illustrated in FIG. 28, which gripper heads 11 receive beverage cans 31 from a supply unit 61 (cf. FIG. 28) and deposit them as a grouping 41 on the transport device 2. Immediately upon being deposited on the transport device 2, the beverage cans 31 of a particular grouping 41 already have an alignment relative to one another that is intended for the positioning of the particular flat packaging blank 20.

Figure 31:
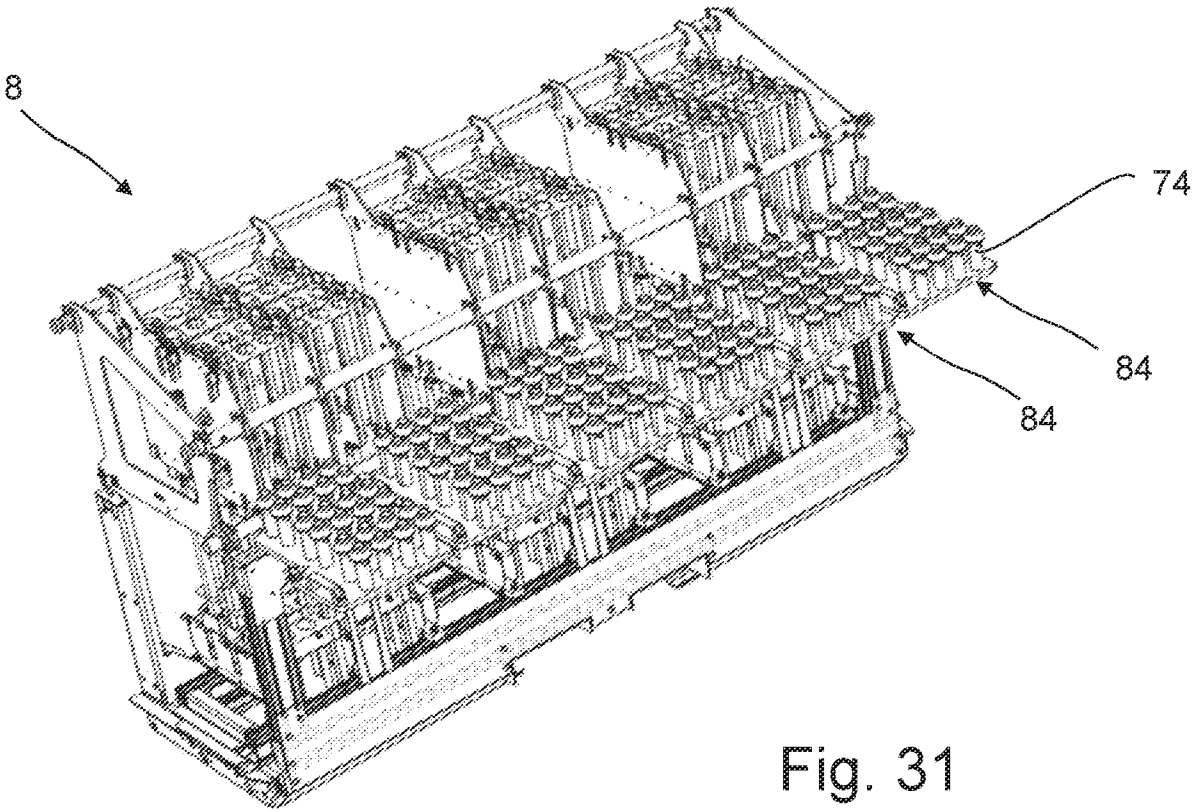

FIG. 31 once more shows in detail the magazine 8 described with FIG. 28, in which flat packaging blanks 20 are arranged in a stacked manner. Furthermore, the format parts 84 are discernible, which each comprise a plurality of dies 74 and which can be exchanged if required.

Figure 32:
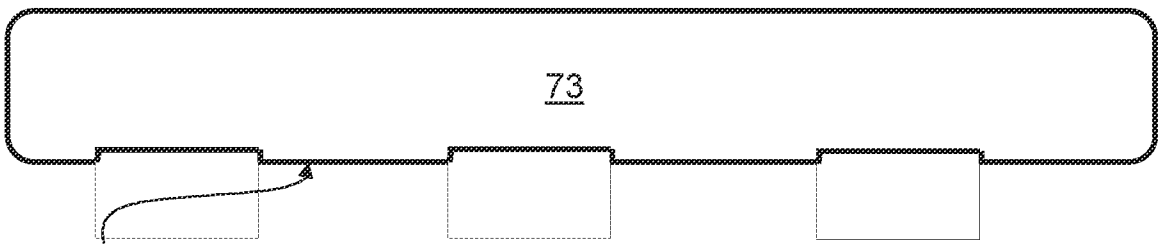
FIG. 32 shows an alternative embodiment for the contact surface of a working tool.

The schematic side view of FIG. 32 shows an alternative embodiment of the contact surface 81 of the manipulation element 73.

Figure 33:
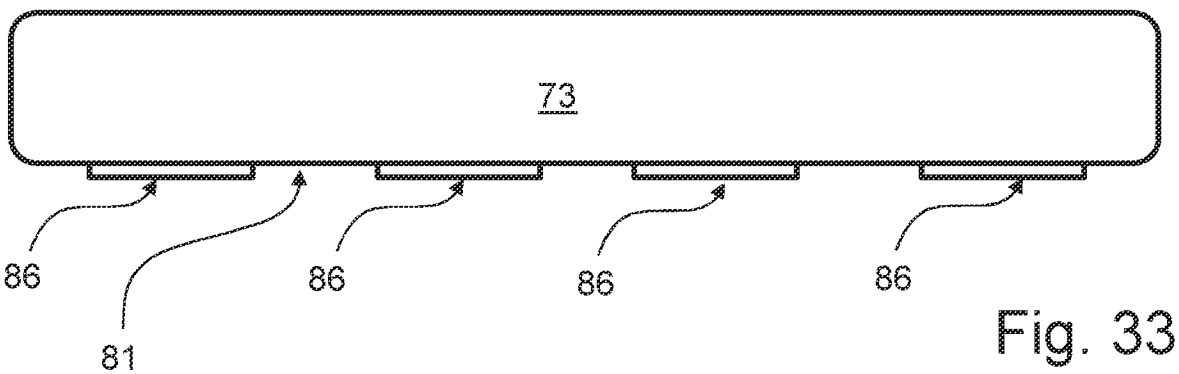
FIG. 33 shows another alternative embodiment for the contact surface of the working tool.

The schematic side view of FIG. 33 shows a further alternative embodiment of the contact surface 81 of the manipulation element 73. At least one controllable contact surface 86 is in addition provided. When the flat packaging blank 20 is pressed onto the contact surface 81, the controllable contact surface 86 is extended out of the plane of the contact surface 81 such that a temporally offset pressing of the flat packaging blank 20 takes place.

During the pressing or temporally before finalizing the pressing procedure, the controllable contact surfaces 86 are actively or passively retracted into the contact surface 81.

The embodiments, examples and alternatives of the preceding paragraphs, the claims, or the following figures and description, including any of their various aspects or respective individual features, may be taken independently or in any combination. Features described in connection with one embodiment are applicable to all embodiments, unless such features are incompatible.

If illustrations and aspects are generally referred to as being "schematic" in the context of the figures, this is by no means intended to imply that the illustrations of the figures and their description are of inferior significance with regard to the disclosure of the invention. The person skilled in the art is fully capable of gathering sufficient information from the schematically and abstractly drawn illustrations for facilitating the understanding of the invention without the understanding being in any way impaired by, for example, the size ratios of the articles and/or of parts of the apparatus or of other of the illustrated elements being drawn and potentially not being precisely true to scale. On the basis of the more concretely explained realizations of the method according to the invention and on the basis of the more concretely explained functionality of the apparatus according to the invention in the figures, the reader as a person skilled in the art is thus enabled to derive a better understanding of the inventive idea, which is formulated in a more general and/or more abstract manner in the claims and in the general part of the description.

The invention has been described with reference to a preferred embodiment. Those skilled in the art will appreciate that numerous changes and modifications can be made to the preferred embodiments of the invention and that such changes and modifications can be made without departing from the spirit of the invention. It is therefore intended that the appended claims cover all such equivalent variations as fall within the true spirit and scope of the invention.

LIST OF REFERENCE NUMBERS

1 Packaging apparatus
2 Transport device
3 Lane
4 Lane guide
5 Rotary module
6 Turntable
7 Packaging module
8 Magazine
9 Pre-treatment module
10 Removal conveyor belt
11 First gripper head
12 Packing bell, packing bells
13 Second gripper head
14 Vacuum cup, suction instrument
15 Third gripper head
16 Vacuum cup
17 Drive
18 Stretching tool, stretching die
19 Stretching cone
20 Packaging blank
**20*v*** Pre-treated packaging blank
21 Carrying handle blank
**21*v*** Pre-treated carrying handle blank
23 Passage opening, passage openings, opening
**23*v*** Passage openings after pre-treatment
24 Edge area, top seam

24*v* Pre-treated edge area
24*e* Heated edge area
25 Securing tab, retaining tab
25*v* Securing tab after pre-treatment
26 Radial cut
27 Cut
28 Partial area
29 Carrying handle opening
30 Article
31 Can, beverage can
32 Lid edge
33 Narrowing, necking
34 Closure
35 Packaging unit
36 Pack
40 Assembly
41 Article group, grouping
50 Tool
51 Pressure punch
60 First module
61 Supply unit
70 Second module
71 Industrial robot
72 Working tool
73 Manipulation element
74 Die
75 Working arm
76 Handling device
77 Carrier
78 Carrier plate
79 Partition, side partition
80 Rear wall
81 Contact surface
82 Tine
83 Transfer tool
84 Format part
85 Supporting tappet
86 Controllable contact surface
d23 Average diameter of a passage opening
d23*v* Average diameter of a passage opening after appropriate pre-treatment
F Application force
FR Conveying direction, transport direction
hA Horizontal axis
S Control device and/or regulating device
vA1 First vertical axis
vA2 Second vertical axis

The invention claimed is:

1. A packaging apparatus (1) used to produce packaging units (35) comprising:

at least one feeder device (2) for at least one article (30) or for an assembly (40) of at least one article (30);

a pre-treatment module (9) comprising at least one resistance reducing device. which contains at least one die, used to prepare a packaging blank (20) for application to the at least one article (30) or assembly (40), wherein the packaging blank (20) comprises at least some portion that is flat and at least one passage opening (23) in the flat portion;

a first packaging module (7) to apply and locate the packaging blank (20) to the at least one article (30) or assembly (40);

a magazine (8) holding a stack of packaging blanks (20);

a gripper (13) that transfers at least one packaging blank (20) from the magazine (8) to the pre-treatment module (9), where the gripper (13) presses the at least one packaging blank (20) on to the at least one die of the at least one resistance reducing device in order to reduce a resistance force in an edge area (24) of the at least one passage opening (23) of the packaging blank (20).

2. The packaging apparatus (1) of claim 1, wherein:

the at least one feeder device (2) is for at least two articles (30) or is for an assembly (40) of at least two articles (30);

the pre-treatment module (9) is to prepare a packaging blank (20) for application to the at least two articles (30) or assembly (40);

the first packaging module (7) is to apply and locate the packaging blank (20) to the at least two articles (30) or assembly (40);

wherein the pre-treatment module (9) comprises at least one resistance reducing device designed to reduce a resistance force in an edge area (24) of the passage openings (23) of the packaging blank (20) for the at least two articles (30) or assembly (40).

3. The packaging apparatus of (1) of claim 2, wherein the resistance reducing device of the pre-treatment module (9) comprises at least one stretching device, at least one cutting device, at least one perforating device, at least one moistening device, or at least one heating device.

4. The packaging apparatus (1) of claim 3, wherein the resistance reducing device comprised a plurality of stretching dies (18), and wherein the plurality of stretching dies (18) are arrangeable in different arrangements or numbers in the pre-treatment module (9).

5. The packaging apparatus of (1) of claim 1, wherein the resistance reducing device of the pre-treatment module (9) comprises at least one stretching device, at least one cutting device, at least one perforating device, at least one moistening device, or at least one heating device.

6. The packaging apparatus (1) of claim 5, wherein the resistance reducing device comprises at least one stretching die (18).

7. The packaging apparatus (1) of claim 6, wherein the at least one stretching die (18) is arranged in a detachable manner in the pre-treatment module (9).

8. The packaging apparatus (1) of claim 7, wherein the resistance reducing device comprises a plurality of stretching dies (18), and wherein the plurality of stretching dies (18) are arrangeable in different arrangements or numbers in the pre-treatment module (9).

9. The packaging apparatus (1) of claim 8, wherein the number and arrangement of the stretching dies (18) correspond to the number and arrangement of the passage openings (23) of the packaging blank (20), and wherein the packaging blank (20) is pressed onto the stretching dies (18) in such a manner that the at least one stretching die (18) passes through the at least one passage opening (23) at least in some areas.

10. The packaging apparatus (1) of claim 5, wherein the resistance reducing device comprises at least one cutting device or at least one perforating device.

11. The packaging apparatus (1) of claim 5, wherein the resistance reducing device comprises at least one moistening device or wherein the resistance reducing device comprises at least one heating device (18).

12. A packaging apparatus (1) used to produce packaging units (35) comprising:

at least one feeder device (2) for the at least one article (30) or for an assembly (40) of at least two articles (30);

a pre-treatment module (9) comprising at least one resistance reducing device designed to reduce a resistance force in an edge area (24) of at least one passage opening (23) of a packaging blank (20) and wherein the at least one resistance reducing device is capable of enlarging an average diameter (d23) of the at least one passage opening (23), the pre-treatment module (9) used to prepare the packaging blank (20) for application to the at least one article (30) or assembly (40), wherein the packaging blank (20) comprises at least some portion that is flat and the at least one passage opening (23) is in the flat portion;

a first packaging module (7) to apply and locate the packaging blank (20) to the at least one article (30) or assembly (40);

a magazine (8) holding a stack of packaging blanks (20);

a gripper (13) that transfers at least one packaging blank (20) from the magazine (8) to the pre-treatment module (9), where the gripper (13) presses the at least one packaging blank (20) on to the at least one die of the least one resistance reducing device in order to enlarge an average diameter (d23) of the at least one passage opening (23).

13. A packaging apparatus (1) used to produce packaging units (35) comprising:

at least one feeder device (2) for at least one article (30) or for an assembly (40) of at least one article (30);

a pre-treatment module (9) comprising at least one resistance reducing device, which contains at least one die, used to prepare a packaging blank (20) for application to the at least one article (30) or assembly (40), wherein the packaging blank (20) comprises at least some portion that is flat and at least one passage opening (23) in the flat portion;

a first packaging module (7) to apply and locate the pre-treated packaging blank to the at least one article (30) or assembly (40);

a magazine (8) holding a stack of packaging blanks (20);

a first gripper (11) and a second gripper (13), wherein the second gripper (13) transfers at least one packaging blank (20) from the magazine (8) on to the at least one die of at least one resistance reducing device of the pre-treatment module (9), and wherein the first gripper (11) presses the at least one packaging blank (20) on to the at least one die of the at least one resistance reducing device in order to reduce a resistance force in an edge area (24) of the at least one passage opening (23) of the packaging blank (20).

14. The packaging apparatus (1) of claim 13, wherein the first gripper (11) transfers the pre-treated packaging blanks toward the at least one article (30) or the assembly (40) of at least one article (30).

* * * * *